US009173272B2

(12) United States Patent
Lee et al.

(10) Patent No.: US 9,173,272 B2
(45) Date of Patent: Oct. 27, 2015

(54) ORGANIC ELECTROLUMINESCENT DISPLAY DEVICE AND METHOD FOR DRIVING THE SAME

(71) Applicant: LG DISPLAY CO., LTD., Seoul (KR)

(72) Inventors: Joon-Suk Lee, Seoul (KR); Bu-Yeol Lee, Goyang-si (KR); Joon-Soo Han, Siheung-si (KR); Binn Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 240 days.

(21) Appl. No.: 13/728,764

(22) Filed: Dec. 27, 2012

(65) Prior Publication Data

US 2014/0077725 A1 Mar. 20, 2014

(30) Foreign Application Priority Data

Sep. 18, 2012 (KR) ..... 10-2012-0103195
Dec. 14, 2012 (KR) ..... 10-2012-0146279

(51) Int. Cl.

| | |
|---|---|
| ***H05B 37/00*** | (2006.01) |
| ***H05B 39/00*** | (2006.01) |
| ***H05B 41/14*** | (2006.01) |
| ***H05B 37/02*** | (2006.01) |
| ***G09G 3/32*** | (2006.01) |

(52) U.S. Cl.

CPC ..... *H05B 37/02* (2013.01); *G09G 3/3225* (2013.01); *G09G 2300/0452* (2013.01); *G09G 2300/0842* (2013.01); *G09G 2310/0281* (2013.01); *G09G 2310/0283* (2013.01)

(58) Field of Classification Search

CPC ..... H05B 37/029; H05B 33/0803; H05B 37/0254; H05B 37/02; H05B 33/0818

USPC ..... 315/312, 504–506, 76

See application file for complete search history.

(56) References Cited

U.S. PATENT DOCUMENTS

| | | | | |
|---|---|---|---|---|
| 7,586,254 | B2 * | 9/2009 | Kwak et al. | 313/504 |
| 7,679,283 | B2 * | 3/2010 | Nimura | 313/506 |
| 7,750,552 | B2 * | 7/2010 | Yamazaki et al. | 313/503 |
| 2004/0022159 | A1 | 2/2004 | Winter | |
| 2004/0113545 | A1 * | 6/2004 | Pang et al. | 313/504 |
| 2004/0227159 | A1 * | 11/2004 | Nakashima et al. | 257/202 |
| 2004/0263425 | A1 * | 12/2004 | Anzai et al. | 345/1.1 |
| 2005/0151830 | A1 * | 7/2005 | Yamazaki | 347/238 |

(Continued)

FOREIGN PATENT DOCUMENTS

| | | |
|---|---|---|
| CN | 1799082 A | 7/2006 |
| CN | 1828709 A | 9/2006 |

(Continued)

*Primary Examiner* — Quan Tra

(74) *Attorney, Agent, or Firm* — Birch, Stewart, Kolasch & Birch, LLP

(57) ABSTRACT

An organic electroluminescent display device includes an organic electroluminescent display panel including top emission pixels to emit light toward a top side of a substrate and bottom emission pixels to emit light toward a bottom side of the substrate, the top emission pixels and the bottom emission pixels being formed such that corresponding ones thereof share a common transparent area, a scan driver for supplying a scan signal to scan lines each connected to selected ones of the top and bottom emission pixels, and a data driver for supplying a data voltage to data lines each connected to selected ones of the top and bottom emission pixels. The top emission pixels and the bottom emission pixels are formed on the substrate to alternate with each other on a pixel basis, on a scan line basis, or a data line basis.

17 Claims, 15 Drawing Sheets

(56) References Cited

U.S. PATENT DOCUMENTS

| | | | | |
|---|---|---|---|---|
| 2006/0038752 | A1* | 2/2006 | Winters | 345/76 |
| 2006/0208981 | A1* | 9/2006 | Rho et al. | 345/88 |
| 2006/0212766 | A1 | 9/2006 | Ko et al. | |
| 2006/0238461 | A1 | 10/2006 | Goh et al. | |
| 2007/0075938 | A1 | 4/2007 | Sung et al. | |
| 2011/0032269 | A1* | 2/2011 | Lukac et al. | 345/606 |

FOREIGN PATENT DOCUMENTS

| | | | |
|---|---|---|---|
| CN | 1851791 | A | 10/2006 |
| CN | 1941050 | A | 4/2007 |
| WO | WO 2004/109640 | A1 | 12/2004 |

* cited by examiner

ORGANIC ELECTROLUMINESCENT DISPLAY DEVICE AND METHOD FOR DRIVING THE SAME

This application claims the benefit of Korean Patent Application No. 10-2012-0103195, filed on Sep. 18, 2012 and Korean Patent Application No. 10-2012-0146279, filed on Dec. 14, 2012, which are hereby incorporated by reference as if fully set forth herein.

BACKGROUND OF THE INVENTION

1. Field of the Invention

The present invention relates to an organic electroluminescent display device with double-sided light emission and a method for driving the same.

2. Discussion of the Related Art

Various flat panel display devices capable of overcoming drawbacks of a cathode ray tube (CRT), namely, heavy and bulky structures, have been proposed. As such a flat panel display device, there is a liquid crystal display device, a field emission display device, a plasma display panel, an organic electroluminescent display device or the like.

In particular, the organic electroluminescent display device, which is a self-luminous device, has advantages of fast response time, high emission efficiency, high luminance, and wide viewing angle, as compared to other flat panel display devices.

Organic electroluminescent display devices are classified into a top emission type organic electroluminescent display device and a bottom emission type organic electroluminescent display device in accordance with the emission direction of light from an organic light emitting layer. Recently, there has been a demand for a double-sided emission type organic electroluminescent display device capable of simultaneously realizing top emission and bottom emission.

SUMMARY OF THE INVENTION

Accordingly, the present invention is directed to an organic electroluminescent display device and a method for driving the same that substantially obviate one or more problems due to limitations and disadvantages of the related art.

An object of the present invention is to provide an organic electroluminescent display device with double-sided light emission and a method for driving the same.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an organic electroluminescent display device includes an organic electroluminescent display panel including top emission pixels to emit light toward a top side of a substrate and bottom emission pixels to emit light toward a bottom side of the substrate, the top emission pixels and the bottom emission pixels being formed such that corresponding ones thereof share a common transparent area, a gate driver for supplying a scan signal to scan lines each connected to selected ones of the top and bottom emission pixels, and a data driver for supplying a data voltage to data lines each connected to selected ones of the top and bottom emission pixels, wherein the top emission pixels and the bottom emission pixels are formed on the substrate to alternate with each other on a pixel basis, on a scan line basis, or a data line basis.

Each of the top and bottom emission pixels may include a switching transistor formed between a corresponding one of the scan lines and a corresponding one of the data lines, a driving transistor including a gate connected to a drain of the switching transistor, and a source connected to a voltage line, to which a high-level voltage is supplied, and an organic light emitting cell including a first electrode connected to a drain of the driving transistor, a second electrode, to which a low-level voltage is supplied, and an organic light emitting layer formed between the first electrode and the second electrode. The top emission pixel may further include a top reflection plate disposed under the organic light emitting layer. The bottom emission pixel may further include a bottom reflection plate disposed over the organic light emitting layer.

The top emission pixels and the bottom emission pixels may be formed to alternate with each other on a scan line basis. The switching transistor of each of the top emission pixels may be connected to one selected from odd-numbered scan lines and even-numbered scan lines. The switching transistor of each of the bottom emission pixels may be connected to the other of the odd and even-numbered scan lines.

The scan driver may include a first scan driver for supplying a scan signal to the scan line connected to the switching transistor of the top emission pixel, and a second scan driver for supplying a scan signal to the scan line connected to the switching transistor of the bottom emission pixel.

The top emission pixels and the bottom emission pixels may be formed to alternate with each other on a data line basis. The switching transistor of each of the top emission pixels may be connected to one selected from odd-numbered data lines and even-numbered data lines. The switching transistor of each of the bottom emission pixels may be connected to the other of the odd and even data lines.

The data driver may include a first data driver for supplying a data signal to the data line connected to the switching transistor of the top emission pixel, and a second data driver for supplying a data signal to the data line connected to the switching transistor of the bottom emission pixel.

The top emission pixels and the bottom emission pixels may be formed to alternate with each other on a pixel basis such that the top and bottom emission pixels are arranged in the form of a mosaic.

In another aspect of the present invention, a method for driving an organic electroluminescent display device includes comprising: supplying a scan signal to scan lines each connected to selected ones of top emission pixels to emit light toward a top side of a substrate and bottom emission pixels to emit light toward a bottom side of the substrate, supplying a data voltage to data lines each connected to selected ones of the top and bottom emission pixels, and rendering images on opposite sides of an organic electroluminescent display panel in which the top emission pixels and the bottom emission pixels are formed on the substrate to alternate with each other, wherein corresponding ones of the top emission pixels and the bottom emission pixels share a common transparent area for transmitting external light therethrough, and the top emission pixels and the bottom emission pixels are formed on the substrate to alternate with each other on a pixel basis, on a scan line basis, or a data line basis.

The rendering images on opposite sides of an organic electroluminescent display panel may include emitting light toward a top side of the organic electroluminescent display panel from the top emission pixels each including a switching transistor formed between a corresponding one of the scan lines and a corresponding one of the data lines, a driving transistor having a gate connected to a drain of the switching transistor and a source connected to a voltage line, to which a high-level voltage is supplied, and an organic light emitting cell having a first electrode connected to a drain of the driving transistor, a second electrode, to which a low-level voltage is supplied, an organic light emitting layer formed between the first electrode and the second electrode, and a top reflection plate disposed under the organic light emitting layer, and emitting light toward a bottom side of the organic electroluminescent display panel from the bottom emission pixels each including a switching transistor formed between a corresponding one of the scan lines and a corresponding one of the data lines, a driving transistor having a gate connected to a drain of the switching transistor of the bottom emission pixel and a source connected to the voltage line, and an organic light emitting cell having a first electrode connected to a drain of the driving transistor of the bottom emission pixel, a second electrode, to which the low-level voltage is supplied, an organic light emitting layer formed between the first electrode and the second electrode in the bottom emission pixel, and a bottom reflection plate disposed under the organic light emitting layer in the bottom emission pixel.

The supplying a scan signal to the scan lines may include supplying the scan signal from a first scan driver to the switching transistors of selected ones of the top emission pixels, the selected top emission pixels being connected to one selected from odd-numbered scan lines and even-numbered the scan lines, and supplying the scan signal from a second scan driver to the switching transistors of selected ones of the bottom emission pixels, the selected bottom emission pixels being connected to the other of the odd and even-numbered scan lines. The rendering images on opposite sides of the organic electroluminescent display panel may include emitting light from the organic light emitting cells of the top emission pixels and the organic light emitting cells of the bottom emission pixels in an alternating manner at intervals of one horizontal period.

The supplying a data voltage to the data lines each connected to selected ones of the top and bottom emission pixels may include comprises supplying a top emission data voltage from a first data driver to the switching transistors of selected ones of the top emission pixels, the selected top emission pixels being connected to one selected from odd-numbered data lines and even-numbered data lines, while supplying a bottom emission data voltage from a second data driver to the switching transistors of selected ones of the bottom emission pixels, the selected bottom emission pixels being connected to the other of the odd and even data lines, when the scan signal is supplied to the scan line to which the selected top emission pixels and the selected bottom emission pixels are connected. The rendering images on opposite sides of the organic electroluminescent display panel may include emitting light from the organic light emitting cells of the top emission pixels and the organic light emitting cells of the bottom emission pixels in a simultaneous manner at intervals of one horizontal period.

The supplying a data voltage to the data lines each connected to selected ones of the top and bottom emission pixels may include supplying a top emission data voltage from a first data driver to the switching transistors of selected ones of the top emission pixels, the selected top emission pixels being connected to an odd one of the data lines and to an odd one of the scan lines, while supplying a top emission data voltage from a second data driver to the switching transistors of selected ones of the bottom emission pixels, the selected bottom emission pixels being connected to even-numbered data lines and to the odd-numbered scan line, when the scan signal is supplied from a first scan driver to the odd-numbered scan line, and supplying a bottom emission data voltage from the first data driver to the switching transistors of selected ones of the bottom emission pixels, the selected bottom emission pixels being connected to the odd-numbered data line and to even-numberedscan lines, while supplying a bottom emission data voltage from the second data driver to the switching transistors of selected ones of the top emission pixels, the selected top emission pixels being connected to the even-numbered data line and to the even-numbed scan line, when the scan signal is supplied to the even-numbered scan line. The organic light emitting cells of the top emission pixels and the organic light emitting cells of the bottom emission pixels may emit light in an alternating manner at intervals of one horizontal period.

In accordance with another aspect of the present invention, an organic electroluminescent display device includes an organic electroluminescent display panel comprising top emission pixels to emit light toward a top side of a substrate and bottom emission pixels to emit light toward a bottom side of the substrate, the top emission pixels and the bottom emission pixels being formed such that corresponding ones thereof share a common transparent area, a scan driver for supplying a scan signal to scan lines each connected to selected ones of the top and bottom emission pixels, and a data driver for supplying a data voltage to data lines each connected to selected ones of the top and bottom emission pixels, wherein the top emission pixels and the bottom emission pixels are formed on the substrate to alternate with each other on a pixel basis, on a scan line basis, or a data line basis, and wherein the top and bottom emission pixels formed on the substrate to alternate with each other on a pixel basis, on a scan line basis or a data line basis share a corresponding one of the data lines.

Selected ones of the top emission pixels connected to an odd one of the scan lines and selected ones of the bottom emission pixels connected to even-numbered scan lines may be connected to a corresponding one of the data lines.

In another aspect of the present invention, a method for driving an organic electroluminescent display device includes supplying a scan signal to scan lines each connected to selected ones of top emission pixels to emit light toward a top side of a substrate and bottom emission pixels to emit light toward a bottom side of the substrate, supplying a data voltage to data lines each connected to selected ones of the top and bottom emission pixels, and rendering images on opposite sides of an organic electroluminescent display panel in which the top emission pixels and the bottom emission pixels are formed on the substrate to alternate with each other, wherein corresponding ones of the top emission pixels and the bottom emission pixels share a common transparent area for transmitting external light therethrough, and the top emission pixels and the bottom emission pixels are formed on the substrate to alternate with each other on a pixel basis, on a scan line basis, or a data line basis.

The step of rendering images on opposite sides of an organic electroluminescent display panel may include the steps of emitting light toward a top side of the organic electroluminescent display panel from the top emission pixels each including a switching transistor formed between a corresponding one of the scan lines and a corresponding one of the data lines, a driving transistor having a gate connected to a drain of the switching transistor and a source connected to a voltage line, to which a high-level voltage is supplied, and an organic light emitting cell having a first electrode connected to a drain of the driving transistor, a second electrode, to which a low-level voltage is supplied, an organic light emitting layer formed between the first electrode and the second electrode, and a top reflection plate disposed beneath the organic light emitting layer, and emitting light toward a bottom side of the organic electroluminescent display panel from the bottom emission pixels each including a switching transistor formed between a corresponding one of the scan lines and a corresponding one of the data lines, a driving transistor having a gate connected to a drain of the switching transistor of the bottom emission pixel and a source connected to the voltage line, and an organic light emitting cell having a first electrode connected to a drain of the driving transistor of the bottom emission pixel, a second electrode, to which the low-level voltage is supplied, an organic light emitting layer formed between the first electrode and the second electrode in the bottom emission pixel, and a bottom reflection plate disposed beneath the organic light emitting layer in the bottom emission pixel.

The step of supplying a scan signal to the scan lines may include the steps of supplying the scan signal to the switching transistor of each of the top emission pixels, which is connected to one selected from odd-numbered scan lines and even-numbered scan lines, and supplying the scan signal to the switching transistor of each of the bottom emission pixels, which is connected to the other of the odd and even-numbered scan lines. The step of rendering images on opposite sides of the organic electroluminescent display panel may include the step of emitting light from the organic light emitting cells of the top emission pixels and the organic light emitting cells of the bottom emission pixels in an alternating manner at intervals of one horizontal period.

The step of supplying a data voltage to the data lines each connected to selected ones of the top and bottom emission pixels may include the steps of supplying a top emission data voltage to the switching transistor of each of the top emission pixels, which is connected to one selected from odd-numbered data lines and even-numbereddata lines, while supplying a bottom emission data voltage to the switching transistor of each of the bottom emission pixels, which is connected to the other of the odd and even data lines, when the scan signal is supplied to the scan line, to which the top emission pixel and the bottom emission pixel are connected. The step of rendering images on opposite sides of the organic electroluminescent display panel may include the step of emitting light from the organic light emitting cells of the top emission pixels and the organic light emitting cells of the bottom emission pixels in a simultaneous manner at intervals of one horizontal period.

The step of supplying a data voltage to the data lines each connected to selected ones of the top and bottom emission pixels may include the steps of supplying a top emission data voltage to the switching transistor of each of the top emission pixels, which is connected to an odd one of the data lines and to odd-numbered scan lines, while supplying a bottom emission data voltage to the switching transistor of each of the bottom emission pixels, which is connected to even-numbered data lines and to the odd-numbered scan line, when the scan signal is supplied to the odd-numbered scan line, and supplying a bottom emission data voltage to the switching transistor of each of the bottom emission pixels, which is connected to the odd-numbered data line and to even-numbered scan lines, while supplying a top emission data voltage to the switching transistor of each of the top emission pixels, which is connected to the even-numbered data line and to the even-numbed scan line, when the scan signal is supplied to the even-numbered scan line. The organic light emitting cells of the top emission pixels and the organic light emitting cells of the bottom emission pixels may emit light in a simultaneous manner at intervals of one horizontal period.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and along with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
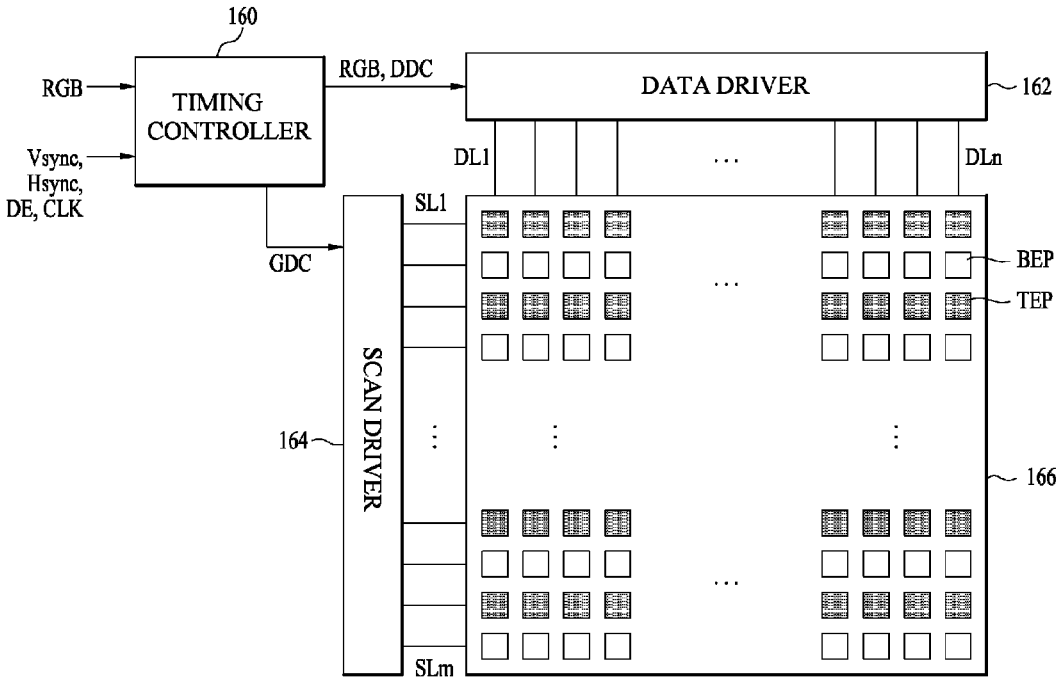
FIG. 1 is a block diagram illustrating an organic electroluminescent display device according to a first embodiment of the present invention.

FIG. 1 is a block diagram illustrating an organic electroluminescent display device according to a first embodiment of the present invention.

The organic electroluminescent display device shown in FIG. 1 includes a light emitting display panel 166, a scan driver 164 for driving scan lines SL1 to SLm of the light emitting display panel 166, a data driver 162 for driving data lines DL1 to DLn of the light emitting display panel 166, and a timing controller 160 for controlling the scan driver 164 and data driver 162.

The timing controller 160 generates a plurality of control signals GDC and DDC to control driving timings of the scan driver 164 and data driver 612, using timing signals Vsync, Hsync, DE, and CLK. The timing controller 160 also aligns digital video data RGB, and supplies the aligned data to the data driver 162.

The scan driver 164 sequentially supplies scan signals to the scan lines SL1 to SLm in response to a scan control signal from the timing controller 160. Thus, the scan driver 164 drives switching transistors connected to the scan lines SL1 to SLm by the unit of one scan line SL.

Under control of the timing controller 160, the data driver 162 converts the digital video data RGB into an analog data voltage, and supplies the analog data voltage to the data lines DL1 to DLn.

Figure 2:
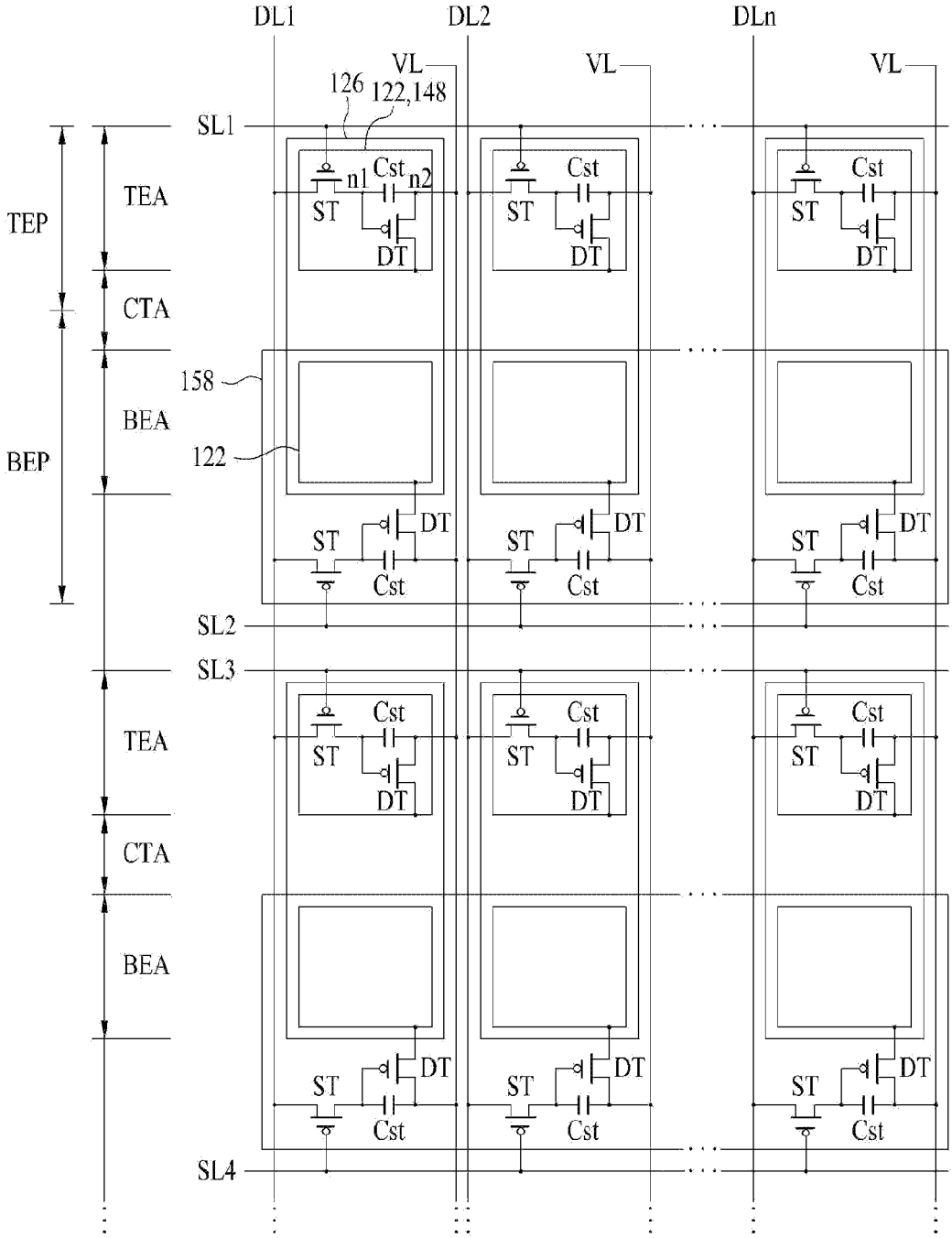
FIG. 2 is a plan view illustrating an embodiment of an organic electroluminescent display panel shown in FIG. 1.

As shown in FIG. 2, the light emitting display panel 166 includes a plurality of top emission pixels TEP, and a plurality of bottom emission pixels BEP alternating with the top emission pixels TEP by the unit of one scan line SL, to realize double-sided emission.

Each of the top emission pixels TEP and bottom emission pixels BEP includes a switching transistor ST, a driving transistor DT, a storage capacitor Cst, an organic light emitting cell, and a reflection plate, which is a top reflection plate 148 in the case of the top emission pixel TEP or a bottom reflection plate 158 in the case of the bottom emission pixel BEP.

The switching transistor ST of each top emission pixel TEP includes a gate electrode connected to a corresponding one of the odd-numbered scan lines SL1, SL3, . . . , SLm-1 , to which scan signals are supplied, respectively, a source electrode connected to a corresponding one of the data lines DL, to which a data signal is supplied, and a drain electrode connected to a first node n1 of the top emission pixel TEP. On the other hand, the switching transistor ST of each bottom emission pixel BEP includes a gate electrode connected to a corresponding one of the even-numbered scan lines SL2, SL4, . . . , SLm, to which scan signals are supplied, respectively, a source electrode connected to a corresponding one of the data lines DL, to which a data signal is supplied, and a drain electrode connected to a first node n1 of the bottom emission pixel BEP. Thus, the switching transistors ST of the top emission pixels TEP and bottom emission pixels BEP, which are connected to the scan lines SL1 to SLm, respectively, while being aligned in an extension direction of the data lines DL, are connected to the same data line DL.

Figure 3:
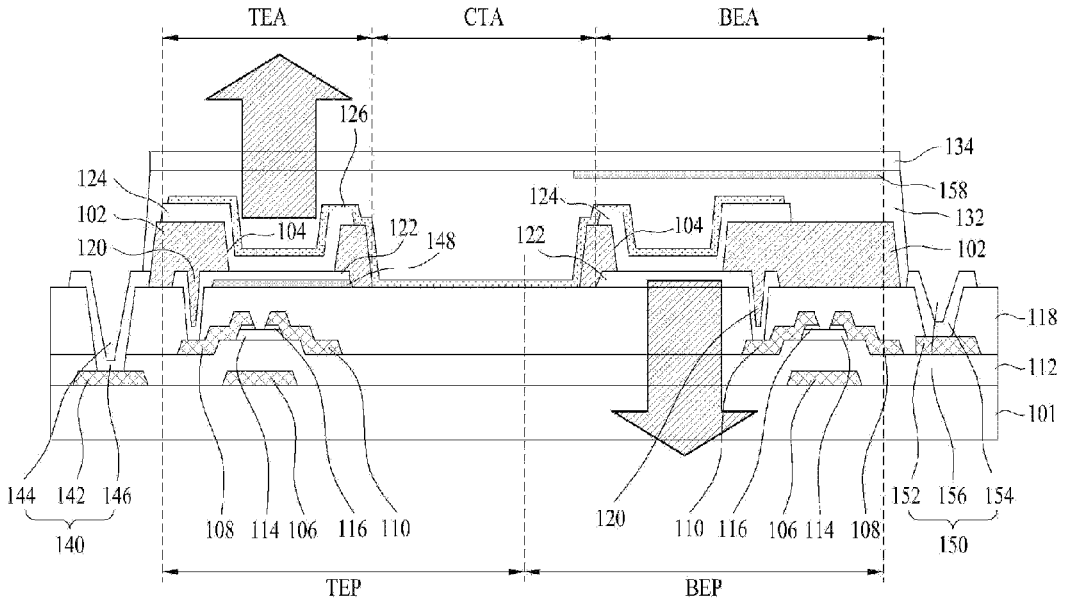
FIG. 3 is a sectional view illustrating the organic electroluminescent display panel shown in FIG. 1.

The driving transistor DT includes a gate electrode connected to the first node n1, a source electrode connected to a second node n2 connected to a voltage line VL to which a high-level voltage is supplied, and a drain electrode connected to a first electrode of the organic light emitting cell. In detail, as shown in FIG. 3, the driving transistor DT includes a gate electrode 106 formed on a bottom substrate 101, a drain electrode 110 connected to a first electrode 122 of the organic light emitting cell, a source electrode 108 formed to face the drain electrode 110, an active layer 114 formed to overlap with the gate electrode 106 via a gate insulating film 112, to form a channel between the source electrode 108 and the drain electrode 110, and an ohmic contact layer 116 formed on the active layer 114, except for the channel, to provide ohmic contacts to the source electrode 108 and drain electrode 110.

The storage capacitor Cst is connected, at one end thereof, to the first node n1 while being connected, at the other end thereof, to the second node n2.

When the switching transistor ST and driving transistor DT are of a PMOS type, the storage capacitor Cst is connected, at one end thereof, to the first node n1 connected to the gate electrode of the driving transistor DT while being connected, at the other end thereof, to the second node n2 connected to the voltage line VL to supply a high-level voltage, as shown in FIG. 2. On the other hand, when the switching transistor ST and driving transistor DT are of an NMOS type, the storage capacitor Cst is connected, at one end thereof, to the first node n1 connected to the gate electrode of the driving transistor DT while being connected, at the other end thereof, to the second node n2 connected to a low-level voltage source to supply a low-level voltage.

In addition to the first electrode 122 connected to the drain electrode 110 of the driving transistor DT, the organic light emitting cell includes a second electrode 126, to which a low-level voltage is supplied, and an organic light emitting layer 124 formed between the first and second electrodes 122 and 126.

The organic light emitting layer 124 includes hole-associated layers, a light emitting layer, and electron-associated layers, which are laminated over the first electrode 122 in this order or vice versa. The organic light emitting layer 124 is formed in a bank hole 104 provided by a bank insulating film 102 formed to define each emission area. The first electrode 122 is electrically connected with the drain electrode 110 via a pixel contact hole 120 extending through a passivation film 118. The first electrode 122 has a multilayer structure having a layer made of an opaque conductive material such as aluminum (Al) and a layer made of a transparent conductive material such as indium tin oxide (ITO) exhibiting high acid resistance and high corrosion resistance or a single layer structure having a layer made of a transparent conductive material, to transmit light generated from the organic light emitting layer 124. Meanwhile, the first electrode 122, organic light emitting layer 124 and second electrode 126 of each top emission pixel TEP is formed to overlap with the driving transistor DT in a front emission area because the path of light generated from the organic light emitting layer 124 of the top emission pixel TEP, which emits light toward a top substrate 134, is not interfered with by the driving transistor DT. On the other hand, the first electrode 122, organic light emitting layer 124 and second electrode 126 of each bottom emission pixel BEP is formed such that it does not overlap with the driving transistor DT in order to prevent the path of light generated from the organic light emitting layer 124 of the bottom emission pixel BEP from being changed by the driving transistor DT.

The top reflection plate 148 prevents light generated from the organic light emitting layer 124 of the top emission pixel TEP from being emitted toward the bottom substrate 101. To this end, the top reflection plate 148 is formed to extend in parallel to the scan lines SL while being disposed beneath the organic light emitting layer 124 of the top emission pixel TEP. For example, the top reflection plate 148 is formed between the first electrode 122 of the top light emitting pixel TEP and the passivation film 118 or between the organic light emitting layer 124 and the first electrode 122. Thus, each top emission pixel TEP has a top emission structure in which the organic light emitting layer 124 in the corresponding top emission area TEA emits light toward the top substrate 134, to display an image.

The bottom reflection plate 158 prevents light generated from the organic light emitting layer 124 of the bottom emission pixel BEP from being emitted toward the top substrate 134. To this end, the bottom reflection plate 158 is formed to extend in parallel to the scan lines SL while being disposed over the organic light emitting layer 124 of the bottom emission pixel BEP. For example, the bottom reflection plate 158 is formed between the top substrate 134 of the bottom emission pixel BEP and an adhesive film 132, between the second electrode 126 and the organic light emitting layer 124, between the second electrode 126 and the adhesive film 132, or on the top substrate 134, through a photolithography process and a deposition process using a shadow mask. Thus, each bottom emission pixel BEP has a bottom emission structure in which the organic light emitting layer 124 in a bottom emission area BEA emits light toward the bottom substrate 101, to display an image.

Meanwhile, adjacent ones of the top emission pixels TEP and bottom emission pixels BEP along each data line DL are formed to share a common transparent area CTA with each other. That is, a common transparent area CTA is formed between the top emission area TEA of each top emission pixel TEP and the bottom emission area BEA of the bottom emission pixel BEP arranged adjacent to the top emission pixel TEP along the corresponding data line DL. In detail, the switching transistor ST, driving transistor DT and storage capacitor Cst of the top emission pixel TEP and the switching transistor ST, driving transistor DT and storage capacitor Cst of the bottom emission pixel BEP are symmetrically formed at opposite sides of the common transparent area CTA.

The common transparent area CTA has a transmission window extending through the bank insulating film 102. The common transparent area CTA is formed through lamination of the bottom substrate 101, gate insulating film 112, passivation film 118, second electrode 126, adhesive film 132, and top substrate 134, which are made of transparent materials. Alternatively, the transmission window of the common transparent area CTA extends not only through the bank insulating film 102, but also through at least one of the passivation film 118 and gate insulating film 112, to increase the transmittance of external light.

The common transparent area CTA passes external light therethrough, to enable the top emission pixel TEP and bottom emission pixel BEP to have sufficient transparency.

Meanwhile, a gate pad 140 and data pad 150 are formed in pad regions of the bottom substrate 101 exposed through the top substrate 134, respectively.

The gate pad 140 is connected to the gate driver 164 and the corresponding scan line SL, to supply a scan signal from the gate driver 164 to the scan line SL. For this function, the gate pad 140 includes a gate pad lower electrode 142 connected to the scan line SL, and a gate pad upper electrode 146 formed on the gate pad lower electrode 142 while being connected to the gate pad lower electrode 142. The gate pad upper electrode 146 is connected to the gate pad lower electrode 142 via a gate contact hole 144 extending through the gate insulating film 112 and passivation film 118.

The data pad 150 is connected to the data driver 162 and the corresponding data line DL, to supply a data voltage from the data driver 162 to the data line DL. For this function, the data pad 150 includes a data pad lower electrode 152 connected to the data line DL, and a data pad upper electrode 156 formed on the data pad lower electrode 152 while being connected to the data pad lower electrode 152. The data pad upper electrode 156 is connected to the data pad lower electrode 152 via a data contact hole 154 extending through the passivation film 118.

The switching transistor ST, driving transistor DT, storage capacitor Cst and organic light emitting cell on the bottom substrate 101 are sealed by the top substrate 134 and the adhesive film 132 formed on a bottom surface of the top substrate 134. The top substrate 134 prevents moisture or oxygen from penetrating into the switching transistor ST, driving transistor DT, storage capacitor Cst and organic light emitting cell.

The adhesive film 132 formed on the bottom surface of the top substrate 134 fills a space defined between the top substrate 134 and the bottom substrate 101. Accordingly, the organic electroluminescent display device can effectively withstand external impact because the adhesive film 101 absorbs the external impact. Thus, the rigidity of the organic electroluminescent display device is enhanced. Meanwhile, a protective insulating film is additionally formed between the organic light emitting cell and the adhesive film 132, to prevent the organic light emitting layer 124 from being damaged by moisture or oxygen. In particular, the protective insulating film is formed to contact the adhesive film 132. Accordingly, it is possible to prevent introduction of moisture, hydrogen or oxygen through side and top surfaces of the organic electroluminescent display device. The protective insulating film may be formed of an inorganic insulating film made of $SiN_x$ or $SiO_x$ or may have a multilayer structure including inorganic insulating films and organic insulating films, which are alternately laminated.

Figure 4:
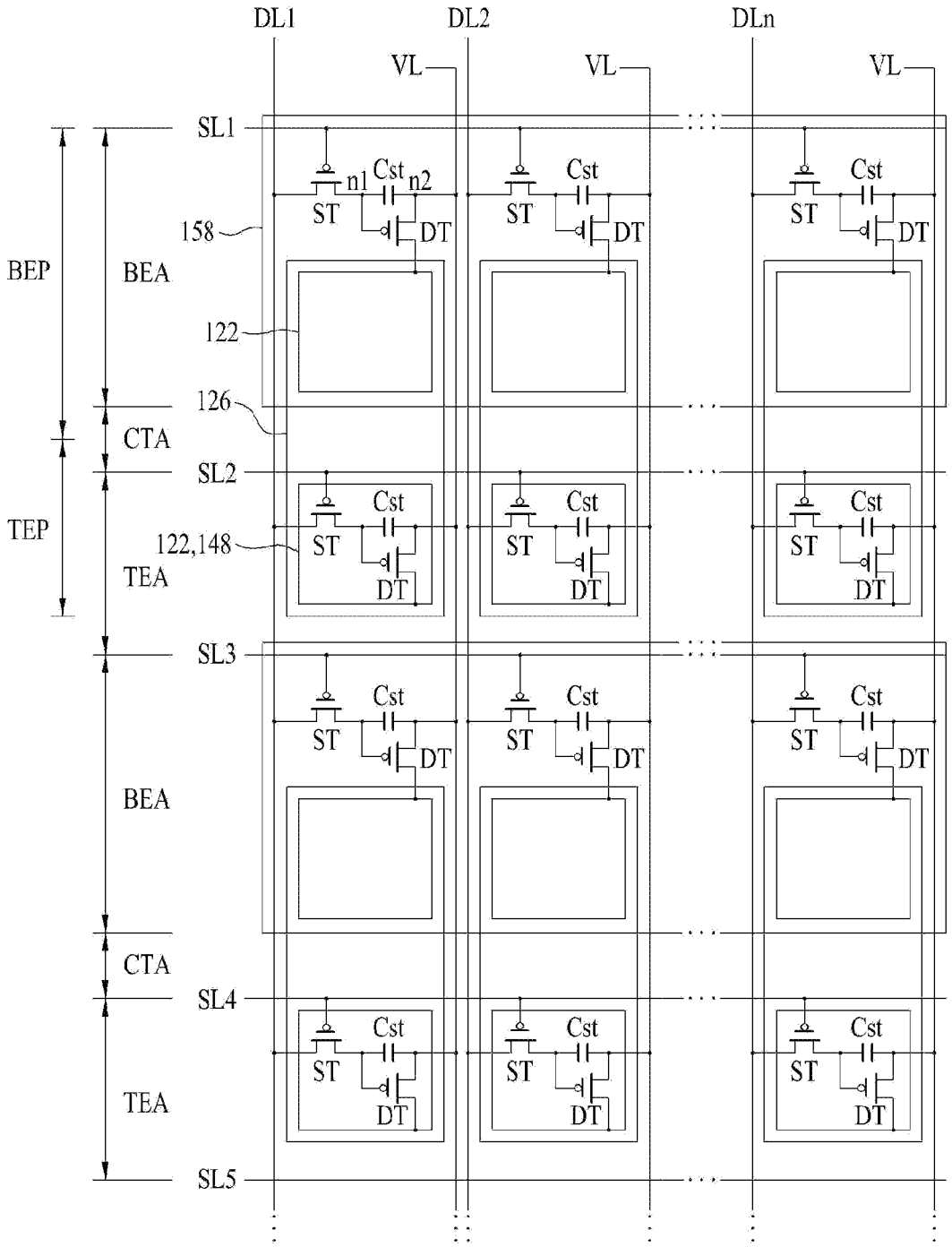
FIG. 4 is a plan view illustrating another embodiment of the organic electroluminescent display panel shown in FIG. 1.

Meanwhile, the organic electroluminescent display panel shown in FIG. 2 has been described in conjunction with the example in which each top emission pixel TEP is connected to a corresponding one of the odd-numbered scan lines SL1, SL3, . . . , SLm-1, and each bottom emission pixel BEP is connected to a corresponding one of the even-numbered scan lines SL2, SL4, . . . , SLm. However, other embodiments may be possible. For example, each bottom emission pixel BEP is connected to a corresponding one of the odd-numbered scan lines SL1, SL3, . . . , SLm-1, and each top emission pixel TEP is connected to a corresponding one of the even-numbered scan lines SL2, SL4, . . . , SLm as shown in, e.g., FIG. 4.

Figure 5:
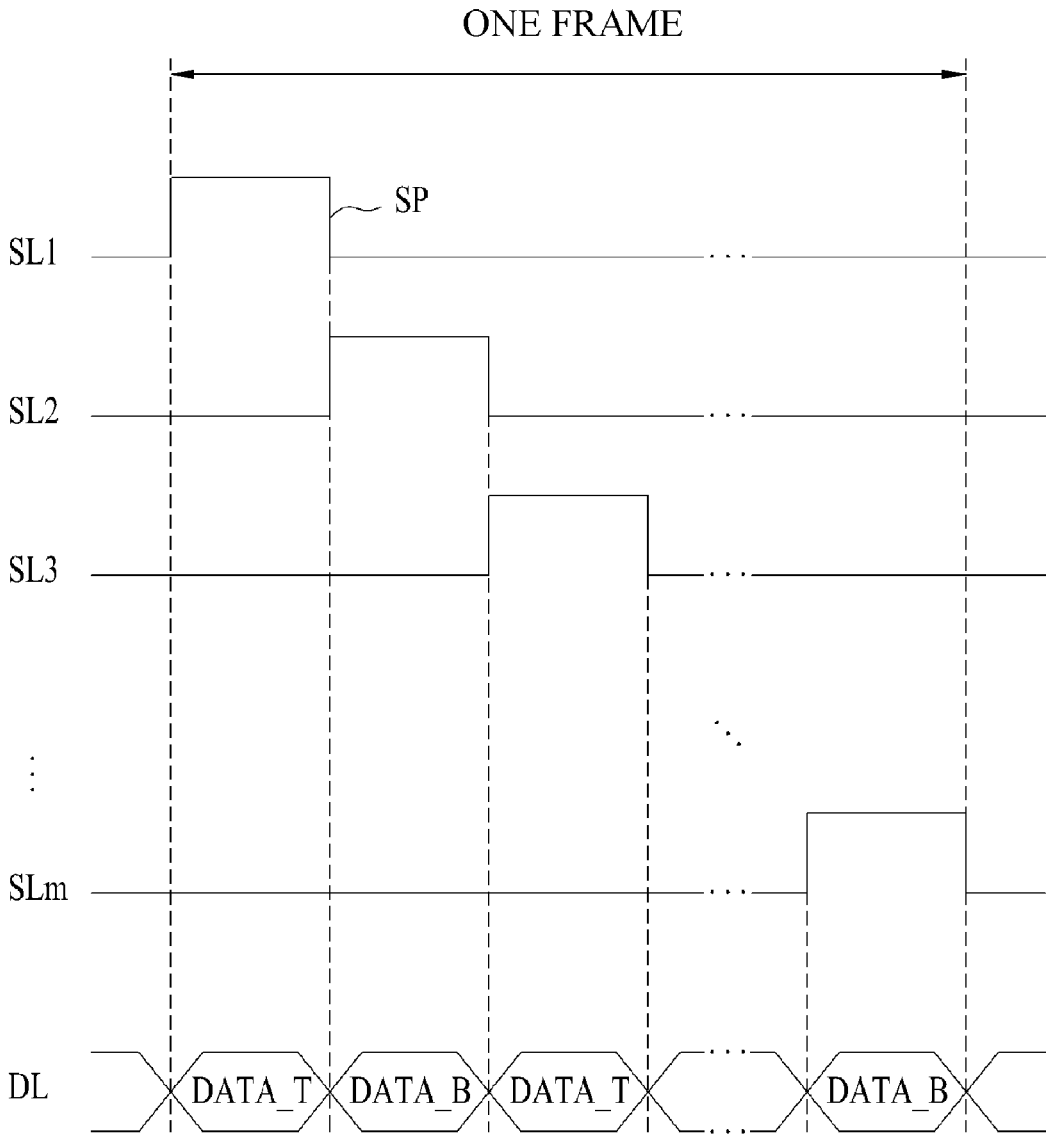
FIG. 5 is a waveform diagram explaining a method for driving the organic electroluminescent display device according to the first embodiment of the present invention.

FIG. 5 is a waveform diagram explaining a method for driving the organic electroluminescent display device according to the first embodiment of the present invention. The driving method illustrate in FIG. 5 will be described in conjunction with the panel structure of the organic electroluminescent display device shown in FIG. 2. For convenience of description, the following description will be given only in conjunction with one top emission pixel TEP and one bottom emission pixel BEP.

First, in a first horizontal period of one frame, a scan signal SP is applied to the first scan line SL1, and a top emission data voltage DATA_T is applied to the data lines DL1 to DLn. In response to the scan signal SP supplied to the first scan line SL1, the switching transistor ST of the top emission pixel TEP is turned on. As a result, the top emission data voltage DATA_T from the data line DL is applied to the gate electrode of the driving transistor DT of the top emission pixel TEP. Then, the driving transistor DT of the top emission pixel TEP adjusts an amount of current flowing through the organic light emitting cell of the top emission pixel TEP in accordance with the gate-source voltage thereof. Thus, top emission is carried out.

Thereafter, the scan signal SP is applied to the second scan line SL2, and a bottom emission data voltage DATA_B is applied to the data lines DL1 to DLn. In response to the scan signal SP supplied to the second scan line SL2, the switching transistor ST of the bottom emission pixel BEP is turned on. As a result, the bottom emission data voltage DATA_B from the data line DL is applied to the gate electrode of the driving transistor DT of the bottom emission pixel BEP. Then, the driving transistor DT of the bottom emission pixel BEP adjusts an amount of current flowing through the organic light emitting cell of the bottom emission pixel BEP in accordance with the gate-source voltage thereof. Thus, bottom emission is carried out.

In accordance with repetition of the above-described operations, in one frame, the organic light emitting cells of the top emission pixels TEP connected to the odd-numbered scan lines SL1, SL3, . . . , SLm-1 and the organic light emitting cells of the bottom emission pixels BEP connected to the even-numbered scan lines SL2, SL4, . . . , SLm emit light in an alternating manner. Thus, it is possible to display different images on opposite sides of the display panel of the organic electroluminescent display device, respectively.

Figure 6:
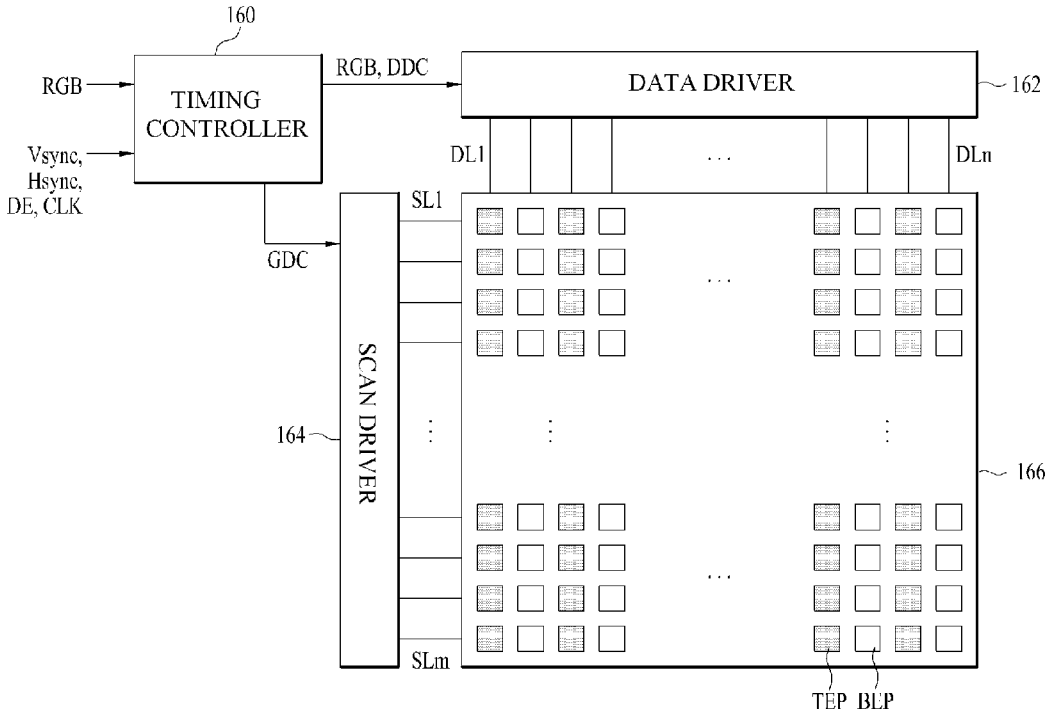
FIG. 6 is a block diagram illustrating an organic electroluminescent display device according to a second embodiment of the present invention.

FIG. 6 is a block diagram illustrating an organic electroluminescent display device according to a second embodiment of the present invention.

The organic electroluminescent display device shown in FIG. 6 includes the same constituent elements as those of the organic electroluminescent display device of FIG. 1, except that a plurality of top emission pixels TEP and a plurality of bottom emission pixels BEP alternate with each other by the unit of one data line DL, to realize double-sided emission. Accordingly, no detailed description will be given of the same constituent elements.

Figure 7:
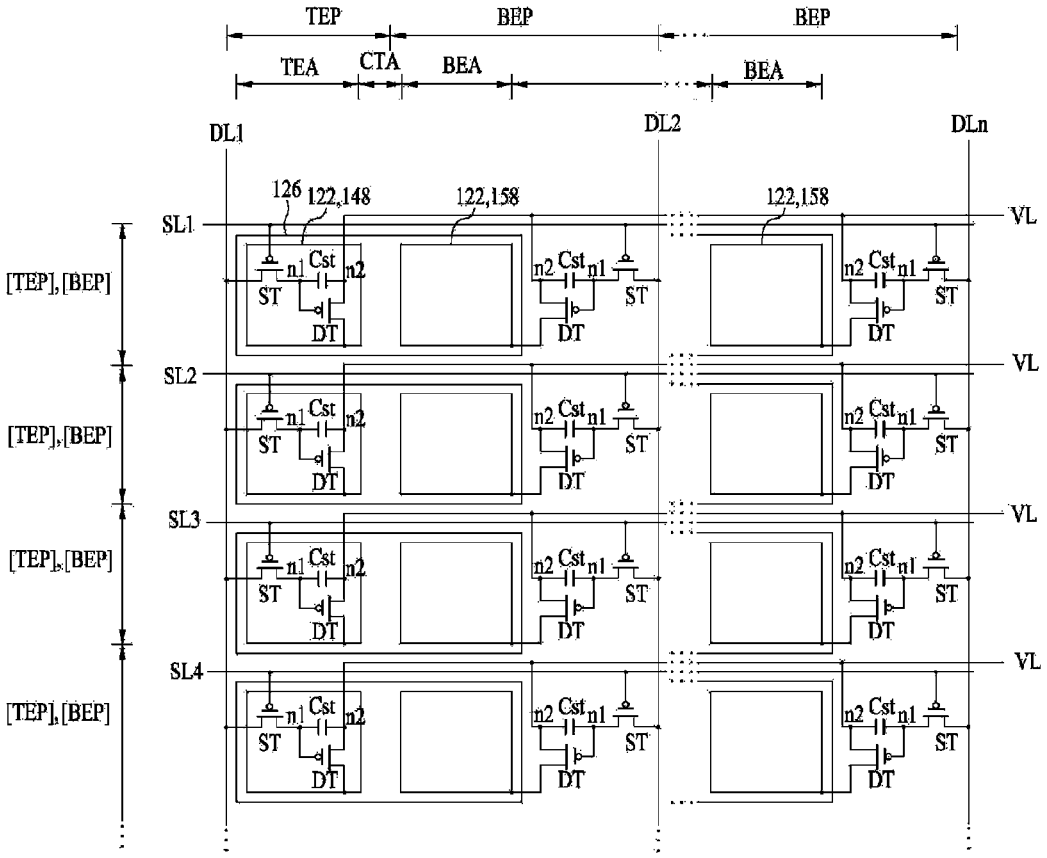
FIG. 7 is a plan view illustrating an organic electroluminescent display panel shown in FIG. 6.

Each of the top emission pixels TEP and bottom emission pixels BEP shown in FIG. 6 includes a switching transistor ST, a driving transistor DT, a storage capacitor Cst, an organic light emitting cell, and a reflection plate, which is a top reflection plate 148 in the case of the top emission pixel TEP or a bottom reflection plate 158 in the case of the bottom emission pixel BEP, as shown in FIG. 7.

The switching transistor ST of each top emission pixel TEP includes a gate electrode connected to a corresponding one of the scan lines DL, to which scan signals are supplied, respectively, a source electrode connected to a corresponding one of the odd-numbered data lines DL1, DL3, . . . , DLn-1, to which a data signal is supplied, and a drain electrode connected to a first node n1 of the top emission pixel TEP. On the other hand, the switching transistor ST of each bottom emission pixel BEP includes a gate electrode connected to a corresponding one of the scan lines SL, to which the scan signals are supplied, respectively, a source electrode connected to a corresponding one of the even-numbered data lines DL2, DL4, . . . , DLn, to which the data signal is supplied, and a drain electrode connected to a first node n1 of the bottom emission pixel BEP.

The driving transistor DT includes a gate electrode connected to the first node n1, a source electrode connected to a second node n2 connected to a voltage line VL to which a high-level voltage is supplied, and a drain electrode connected to a first electrode 122 of the organic light emitting cell.

The storage capacitor Cst is connected, at one end thereof, to the first node n1 while being connected, at the other end thereof, to the second node n2.

In addition to the first electrode 122 connected to the drain electrode 110 of the driving transistor DT, the organic light emitting cell includes a second electrode 126, to which a low-level voltage is supplied, and an organic light emitting layer 124 formed between the first and second electrodes 122 and 126, The top reflection plate 148 overlaps with the first electrode 122 of the top emission pixel TEP extending in parallel to the data lines DL, to prevent light generated from the organic light emitting layer 124 of the top emission pixel TEP from being emitted toward the bottom substrate 101. Thus, each top emission pixel TEP has a top emission structure in which the organic light emitting layer 124 in the corresponding top emission area TEA emits light toward the top substrate 134, to display an image.

The bottom reflection plate 158 overlaps with the first electrode 122 of the bottom emission pixel BEP extending in parallel to the data lines DL, to prevent light generated from the organic light emitting layer 124 of the bottom emission pixel BEP from being emitted toward the top substrate 134. Thus, each bottom emission pixel BEP has a bottom emission structure in which the organic light emitting layer 124 in a bottom emission area BEA emits light toward the bottom substrate 101, to display an image.

Meanwhile, adjacent ones of the top emission pixels TEP and bottom emission pixels BEP along each scan line SL are formed to share a common transparent area CTA with each other, as shown in FIG. 7. Since the common transparent area CTA passes external light therethrough, the top emission pixel TEP and bottom emission pixel BEP can have sufficient transparency.

Figure 8:
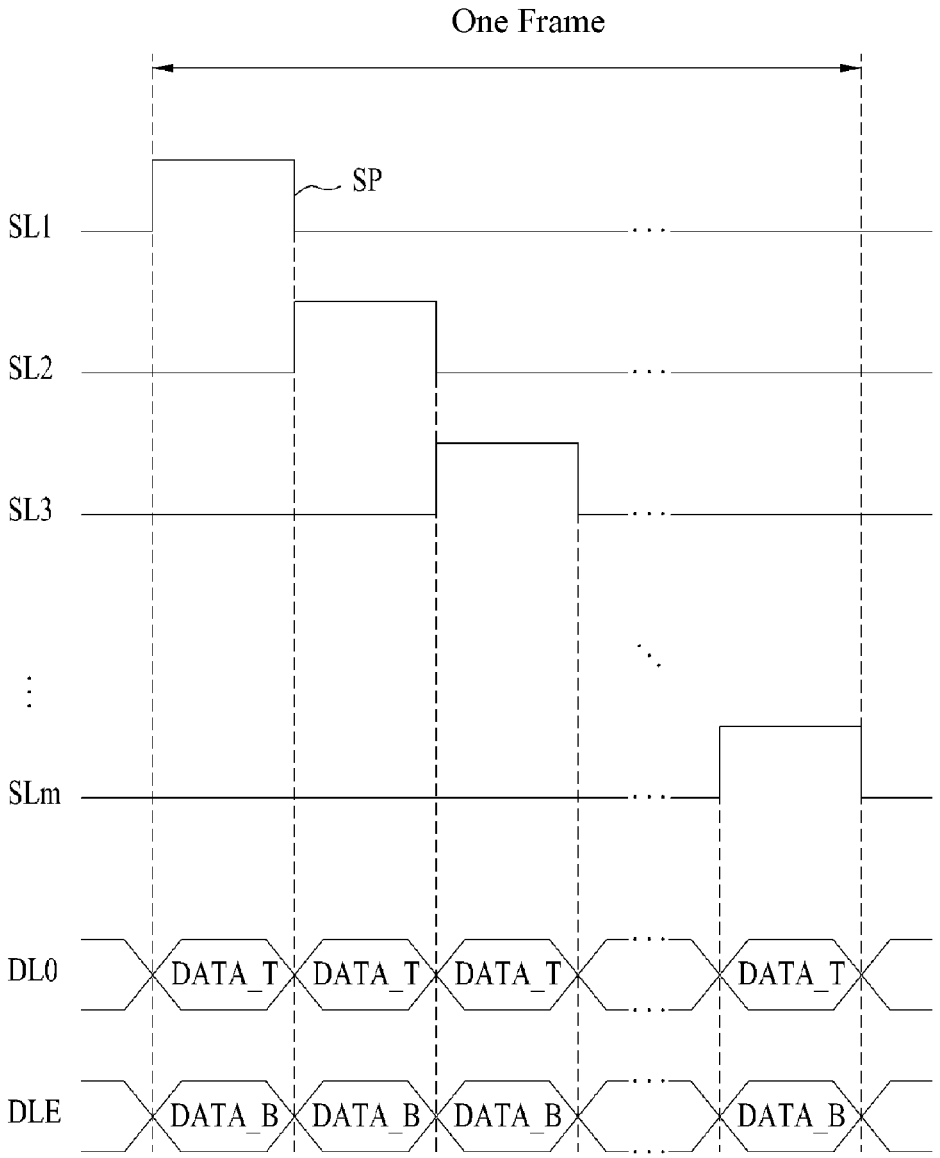
FIG. 8 is a waveform diagram explaining a method for driving the organic electroluminescent display device according to the second embodiment of the present invention.

FIG. 8 is a waveform diagram explaining a method for driving the organic electroluminescent display device according to the second embodiment of the present invention.

First, in one frame, scan signals SP are sequentially applied to the scan lines SL1 to SLm, respectively, and a top emission data voltage DATA_T is applied to the odd-numbered data lines DLO (DL1, DL3, . . . , DLn-1). Also, a bottom emission data voltage DATA_B is applied to the even-numbered data lines DLE (DL2, DL4, . . . , DLn). In response to the scan signal SP supplied to each scan line SL, the switching transistor ST of each of the top emission pixels TEP connected to the scan line SL while being connected to respective odd-numbered data lines DLO is turned on. Also, the switching transistor ST of each of the bottom emission pixels BEP connected to the scan line SL while being connected to respective even-numbered data lines DLE is turned on. As a result, the top emission data voltage DATA_T from each odd-numbered data line DLO is applied to the gate electrode of the driving transistor DT of each top emission pixel TEP connected to the odd-numbered data line DLO. Also, the bottom emission data voltage DATA_B from each even-numbered data line DLE is applied to the gate electrode of the driving transistor DT of each bottom emission pixel BEP connected to the even-numbered data line DLE. Then, the driving transistor DT of the top emission pixel TEP adjusts an amount of current flowing through the organic light emitting cell of the top emission pixel TEP in accordance with the gate-source voltage thereof. Thus, top emission is carried out. Also, the driving transistor DT of the bottom emission pixel BEP adjusts an amount of current flowing through the organic light emitting cell of the bottom emission pixel BEP in accordance with the gate-source voltage thereof. Thus, bottom emission is carried out.

In accordance with repetition of the above-described operations, in one frame, the organic light emitting cells of the top emission pixels TEP connected to the odd-numbered data lines DL1, DL3, . . . , DLn-1 emit light toward the top side, and the organic light emitting cells of the bottom emission pixels BEP connected to the even-numbered data lines DL2, DL4, . . . , DLn emit light toward the bottom side. That is, the organic light emitting cells of the top emission pixels TEP and the organic light emitting cells of the bottom emission pixels BEP simultaneously emit light for every horizontal period. Thus, it is possible to display different images on opposite sides of the display panel of the organic electroluminescent display device, respectively.

Figure 9:
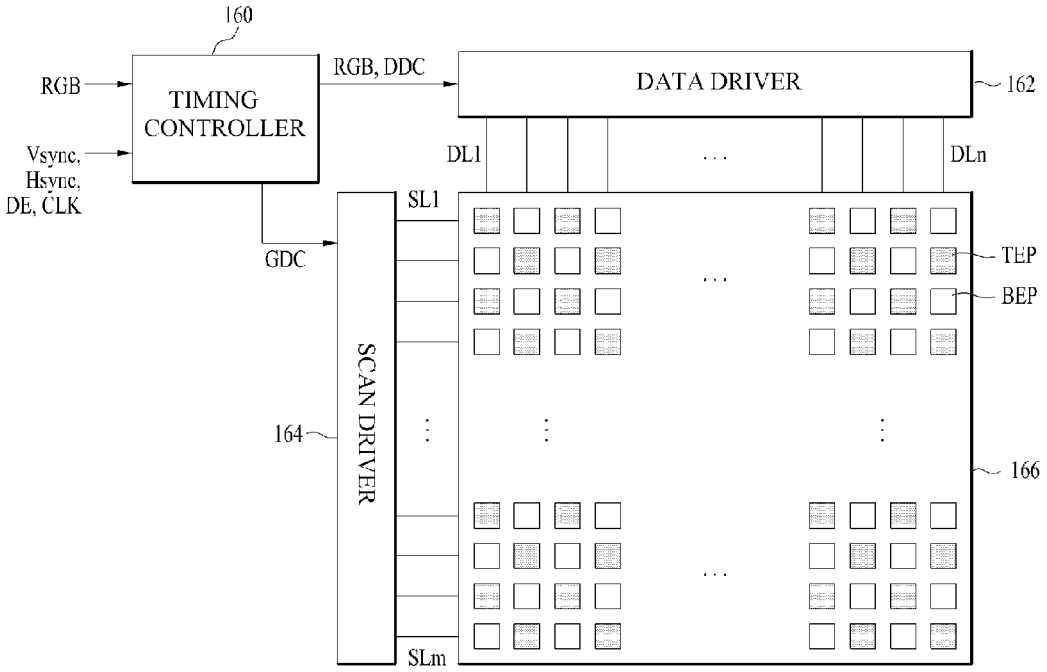
FIG. 9 is a block diagram illustrating an organic electroluminescent display device according to a third embodiment of the present invention.

FIG. 9 is a block diagram illustrating an organic electroluminescent display device according to a third embodiment of the present invention.

The organic electroluminescent display device shown in FIG. 9 includes the same constituent elements as those of the organic electroluminescent display device of FIG. 1, except that a plurality of top emission pixels TEP and a plurality of bottom emission pixels BEP alternate with each other on a pixel basis such that they are arranged in the form of a mosaic, to realize double-sided emission. Accordingly, no detailed description will be given of the same constituent elements.

Figure 10:
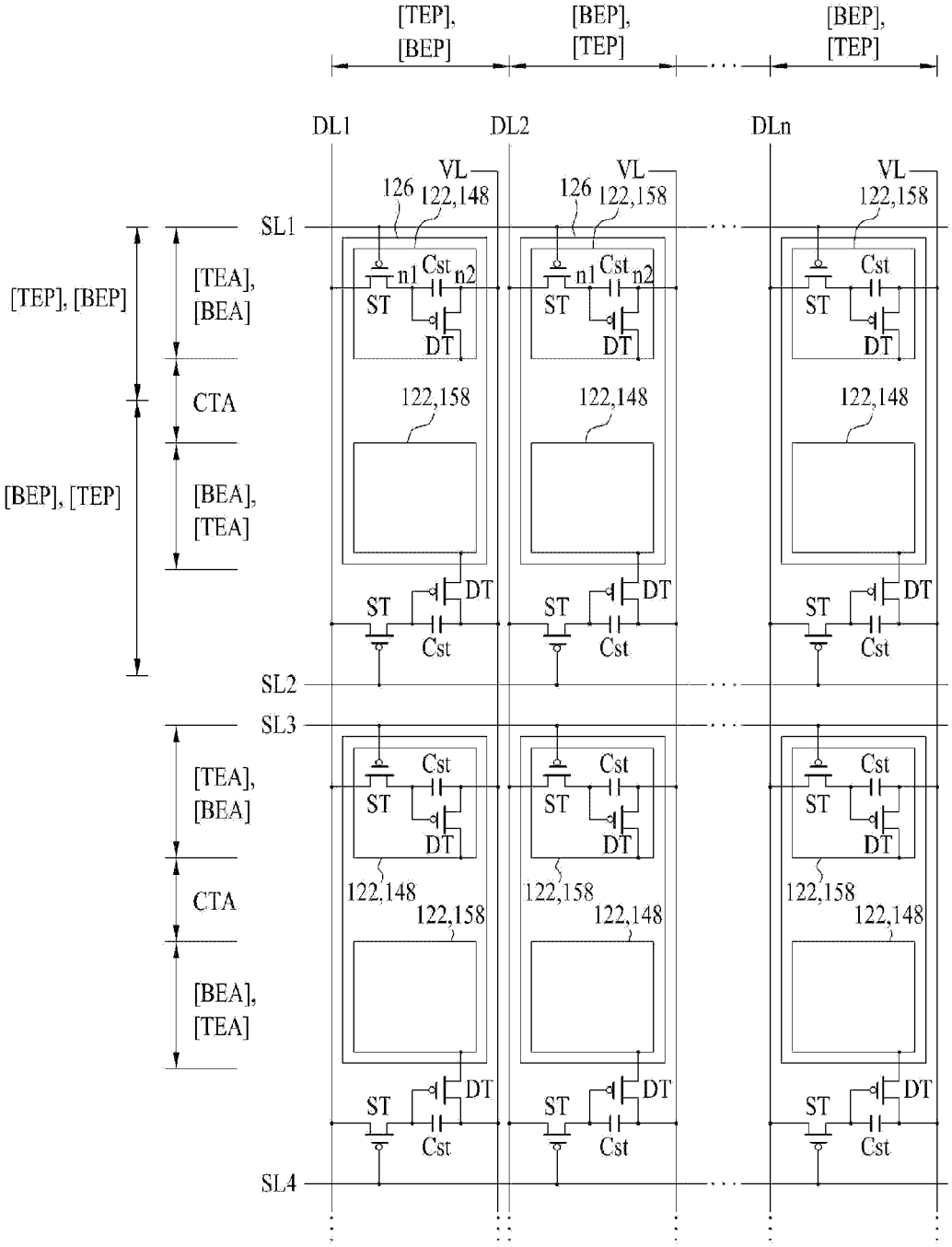
FIG. 10 is a plan view illustrating an organic electroluminescent display panel shown in FIG. 9.

Each of the top emission pixels TEP and bottom emission pixels BEP shown in FIG. 9 includes a switching transistor ST, a driving transistor DT, a storage capacitor Cst, an organic light emitting cell, and a reflection plate, which is a top reflection plate 148 in the case of the top emission pixel TEP or a bottom reflection plate 158 in the case of the bottom emission pixel BEP, as shown in FIG. 10.

The switching transistor ST of each top emission pixel TEP includes a gate electrode connected to a corresponding one of the scan lines DL, to which scan signals are supplied, respectively, a source electrode connected to a corresponding one of the data lines DL, to which data voltages are supplied, respectively, and a drain electrode connected to a first node n1 of the top emission pixel TEP. In particular, the switching transistor ST of each top emission pixel TEP connected to a corresponding one of the odd-numbered scan lines SL1, SL3, . . . , SLm-1 receives a top emission data voltage from a corresponding one of the odd-numbered data lines DL1, DL3, . . . , DLn-1. Also, the switching transistor ST of each top emission pixel TEP connected to a corresponding one of the even-numbered scan lines SL2, SL4, . . . , SLm receives a top emission data voltage from a corresponding one of the even-numbered data lines DL2, DL4, . . . , DLn.

The switching transistor ST of each bottom emission pixel BEP includes a gate electrode connected to a corresponding one of the scan lines DL, to which scan signals are supplied, respectively, a source electrode connected to a corresponding one of the data lines DL, to which data voltages are supplied, respectively, and a drain electrode connected to a first node n1 of the bottom emission pixel BEP. In particular, the switching transistor ST of each bottom emission pixel BEP connected to a corresponding one of the odd-numbered scan lines SL1, SL3, . . . , SLm-1 receives a bottom emission data voltage from a corresponding one of the even-numbered data lines DL2, DL4, . . . , DLn. Also, the switching transistor ST of each bottom emission pixel BEP connected to a corresponding one of the even-numbered scan lines SL2, SL4, . . . , SLm receives a bottom emission data voltage from a corresponding one of the odd-numbered data lines DL1, DL3, . . . , DLn-1.

The driving transistor DT includes a gate electrode connected to the first node n1, a source electrode connected to a second node n2 connected to a voltage line VL to which a high-level voltage is supplied, and a drain electrode connected to a first electrode 122 of the organic light emitting cell.

The storage capacitor Cst is connected, at one end thereof, to the first node n1 while being connected, at the other end thereof, to the second node n2.

In addition to the first electrode 122 connected to the drain electrode 110 of the driving transistor DT, the organic light emitting cell includes a second electrode 126, to which a low-level voltage is supplied, and an organic light emitting layer 124 formed between the first and second electrodes 122 and 126.

The top reflection plate 148 overlaps with the first electrode 122 of the top emission pixel TEP, which is arranged in the form of a mosaic, to prevent light generated from the organic light emitting layer 124 of the top emission pixel TEP from being emitted toward the bottom substrate 101. Thus, each top emission pixel TEP has a top emission structure in which the organic light emitting layer 124 in the corresponding top emission area TEA emits light toward the top substrate 134, to display an image.

The bottom reflection plate 158 overlaps with the first electrode 122 of the bottom emission pixel BEP, which is arranged in the form of a mosaic, to prevent light generated from the organic light emitting layer 124 of the bottom emission pixel BEP from being emitted toward the top substrate 134. Thus, each bottom emission pixel BEP has a bottom emission structure in which the organic light emitting layer 124 in a bottom emission area BEA emits light toward the bottom substrate 101, to display an image.

Meanwhile, adjacent ones of the top emission pixels TEP connected to the odd-numbered scan lines SL1, SL3, . . . , SLm-1 and the top emission pixels TEP connected to the even-numbered scan lines SL2, SL4, . . . , SLm are formed to share a common transparent area CTA, as shown in FIG. 10. Also, adjacent ones of the bottom emission pixels BEP connected to the odd-numbered scan lines SL1, SL3, . . . , SLm-1 and the bottom emission pixels BEP connected to the even-numbered scan lines SL2, SL4, . . . , SLm are formed to share a common transparent area CTA, as shown in FIG. 10. Since the common transparent areas CTA transmit external light therethrough, the top emission pixels TEP and bottom emission pixels BEP can have sufficient transparency.

Figure 11:
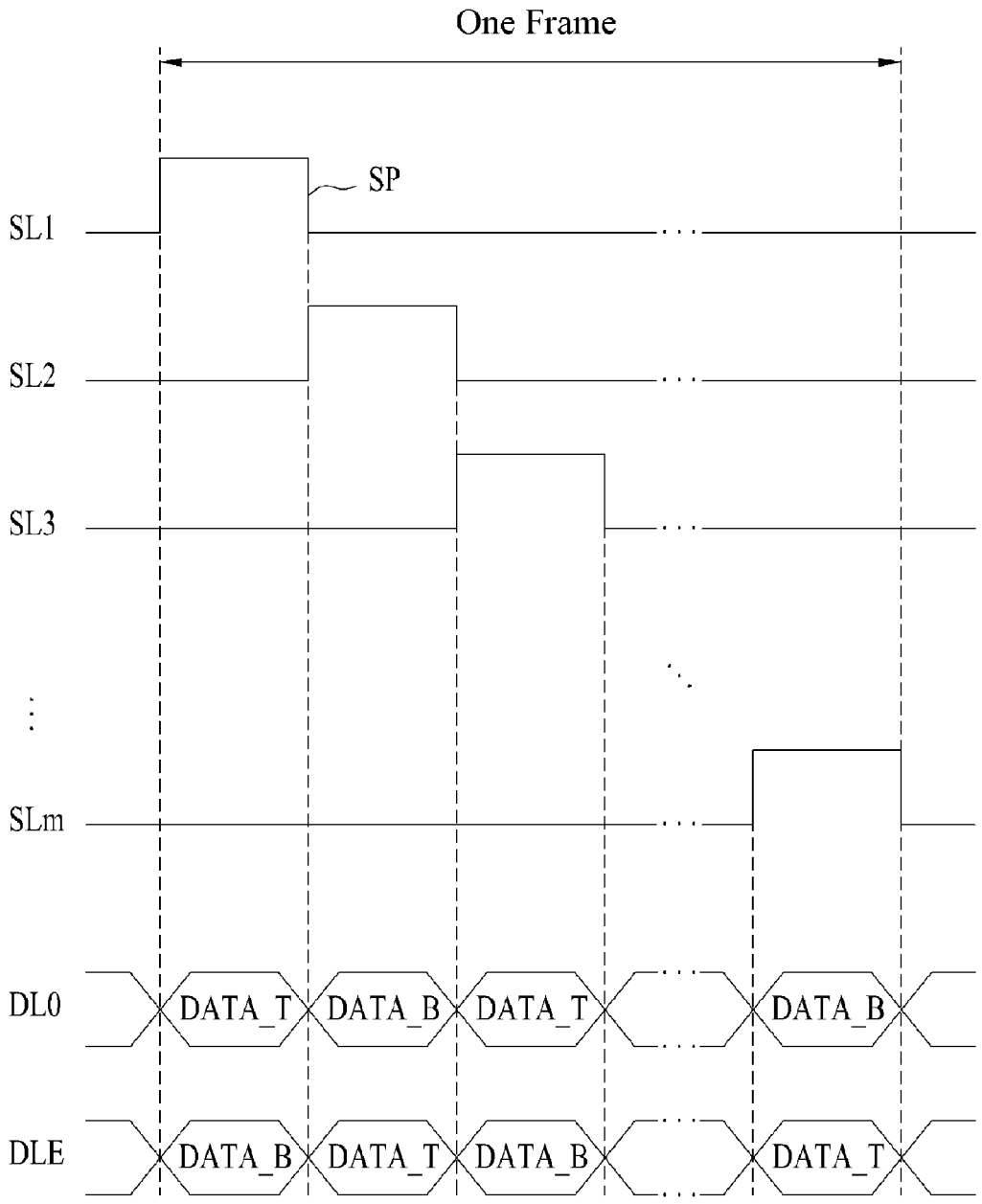
FIG. 11 is a waveform diagram explaining a method for driving the organic electroluminescent display device according to the third embodiment of the present invention.

FIG. 11 is a waveform diagram explaining a method for driving the organic electroluminescent display device according to the third embodiment of the present invention.

First, in a first horizontal period of one frame, a scan signal SP is applied to the first scan line SL1, and a top emission data voltage DATA_T is applied to the odd-numbered data lines DLO (DL1, DL3, . . . , DLn-1). Also, a bottom emission data voltage DATA_B is applied to the even-numbered data lines DLE (DL2, DL4, . . . , DLn). In response to the scan signal SP supplied to the first scan line SL1, the switching transistor ST of each of the top emission pixels TEP connected to each odd-numbered data line DLO while being connected to the first scan line SL1 is turned on. Also, the switching transistor ST of each of the bottom emission pixels BEP connected to each even-numbered data line DLE while being connected to the first scan line SL1 is turned on. As a result, the top emission data voltage DATA_T from each odd-numbered data line DLO is applied to the gate electrode of the driving transistor DT of each top emission pixel TEP connected to the odd-numbered data line DLO. Also, the bottom emission data voltage DATA_B from each even-numbered data line DLE is applied to the gate electrode of the driving transistor DT of each bottom emission pixel BEP connected to the even-numbered data line DLE. Then, the driving transistor DT of the top emission pixel TEP adjusts an amount of current flowing through the organic light emitting cell of the top emission pixel TEP in accordance with the gate-source voltage thereof. Thus, top emission is carried out. Also, the driving transistor DT of the bottom emission pixel BEP adjusts an amount of current flowing through the organic light emitting cell of the bottom emission pixel BEP in accordance with the gate-source voltage thereof. Thus, bottom emission is carried out.

Thereafter, the scan signal SP is applied to the second scan line SL2. Also, the bottom emission data voltage DATA_B is applied to the odd-numbered data lines DLO (DL1, DL3, . . . , DLn-1), and the top emission data voltage DATA_T is applied to the even-numbered data lines DLE (DL2, DL4, . . . , DLn). In response to the scan signal SP supplied to the second scan line SL2, the switching transistor ST of each of the bottom emission pixels BEP connected to each odd-numbered data line DLO while being connected to the second scan line SL2 is turned on. Also, the switching transistor ST of each of the top emission pixels TEP connected to each even-numbered data line DLE while being connected to the second scan line SL2 is turned on. As a result, the bottom emission data voltage DATA_B from each odd-numbered data line DLO is applied to the gate electrode of the driving transistor DT of each bottom emission pixel BEP connected to the odd-numbered data line DLO. Also, the top emission data voltage DATA_T from each even-numbered data line DLE is applied to the gate electrode of the driving transistor DT of each top emission pixel TEP connected to the even-numbered data line DLE. Then, the driving transistor DT of the top emission pixel TEP adjusts an amount of current flowing through the organic light emitting cell of the top emission pixel TEP in accordance with the gate-source voltage thereof. Thus, top emission is carried out. Also, the driving transistor DT of the bottom emission pixel BEP adjusts an amount of current flowing through the organic light emitting cell of the bottom emission pixel BEP in accordance with the gate-source voltage thereof. Thus, bottom emission is carried out.

In accordance with repetition of the above-described operations, the organic light emitting cells of the top emission pixels TEP and bottom emission pixels BEP connected to each of the odd-numbered scan lines SL1, SL3, . . . , SLm-1 simultaneously emit light for a corresponding one of the horizontal periods in one frame. Also, the organic light emitting cells of the bottom emission pixels BEP and top emission pixels TEP connected to each of the even-numbered scan lines SL2, SL4, . . . , SLm simultaneously emit light for a corresponding one of the horizontal periods in one frame. Thus, it is possible to display different images on opposite sides of the display panel of the organic electroluminescent display device, respectively.

The present invention has been described in conjunction with an example in which the top emission pixels and the bottom emission pixels are individually driven through one scan driver and one data driver. However, it may be possible to display different images on opposite sides of the display panel of the organic electroluminescent display device, respectively, through a configuration including at least one of a scan driver and a data driver, which operate to drive the top emission pixels, and at least one of a scan driver and a data driver, which operate to drive the bottom emission pixels.

Figure 12:
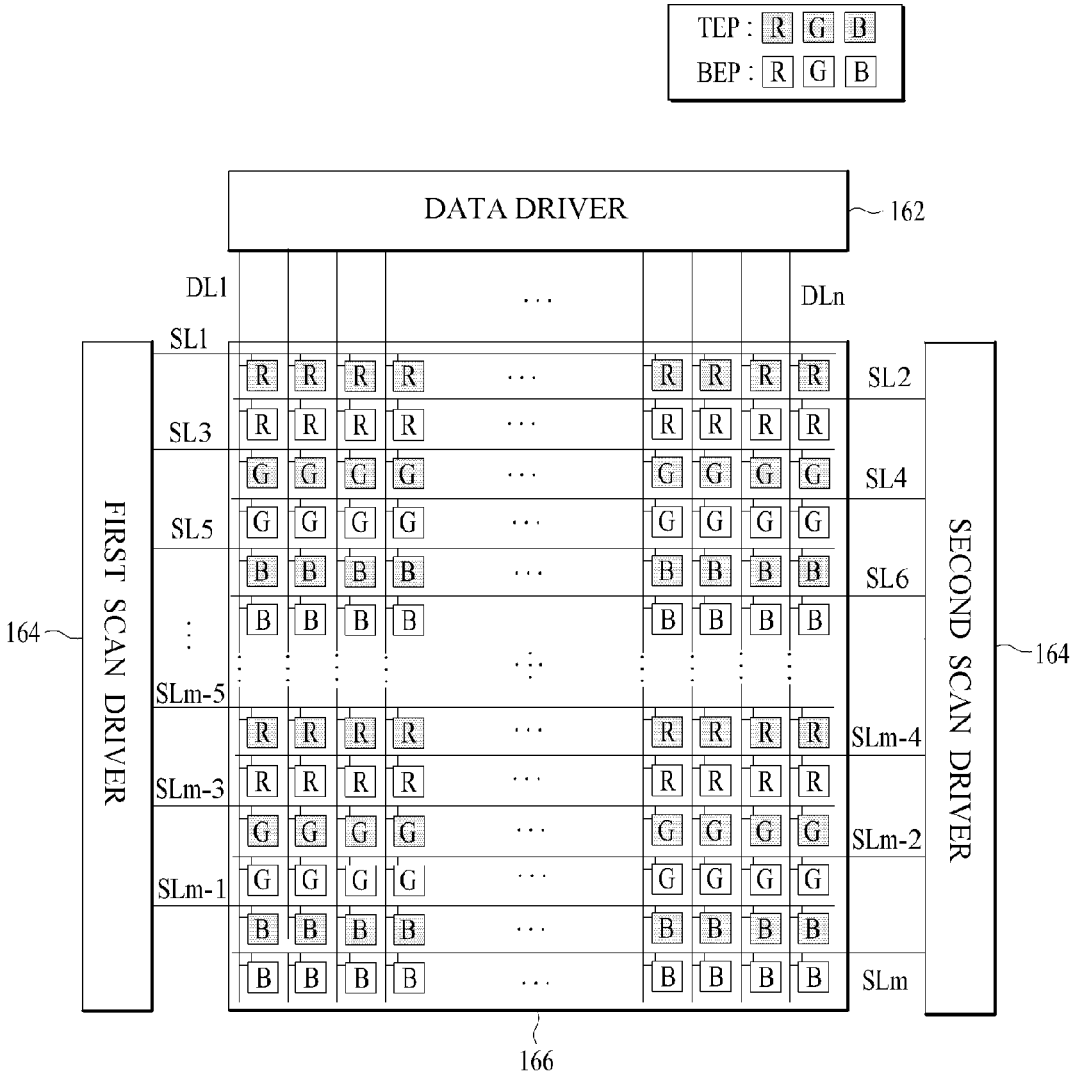
FIG. 12 is a block diagram illustrating arrangement of red, green, and blue emission pixels in the organic electroluminescent display panel shown in FIG. 5.

In detail, when top emission pixels TEP and bottom emission pixels BEP are formed to alternate with each other on a scan line (SL) basis, as shown in FIG. 12, they may be arranged such that adjacent ones of the top emission pixels TEP and bottom emission pixels BEP in an extension direction of the data lines DL, namely, a vertical direction in FIG. 12, render the same color. In this case, accordingly, emission pixels are arranged such that emission pixels rendering the same color are arranged along each scan line SL, and emission pixels of at least three colors are repeatedly arranged on a 2i-pixel basis (i: a natural number) along each data line DL. For example, the top emission pixels TEP connected to the "6j+1"-th scan line (j: a natural number including "0") and the bottom emission pixels BEP connected to the "6j+2"-th scan line render red R. The top emission pixels TEP connected to the "6j+3"-th scan line and the bottom emission pixels BEP connected to the "6j+4"-th scan line render green G. The top emission pixels TEP connected to the "6j+5"-th scan line and the bottom emission pixels BEP connected to the "6j+6"-th scan line render blue B. In this case, a scan signal is supplied to each of the odd-numbered scan lines SL1, SL3, SL5, . . . , SLm-1 connected to the top emission pixels TEP from a first scan driver 164 disposed at one side of the light emitting panel 166. Also, a scan signal is supplied to each of the even-numbered scan lines SL2, SL4, SL6, . . . , SLm connected to the top emission pixels TEP from a second scan driver 164 disposed at the other side of the light emitting panel 166.

Figure 13:
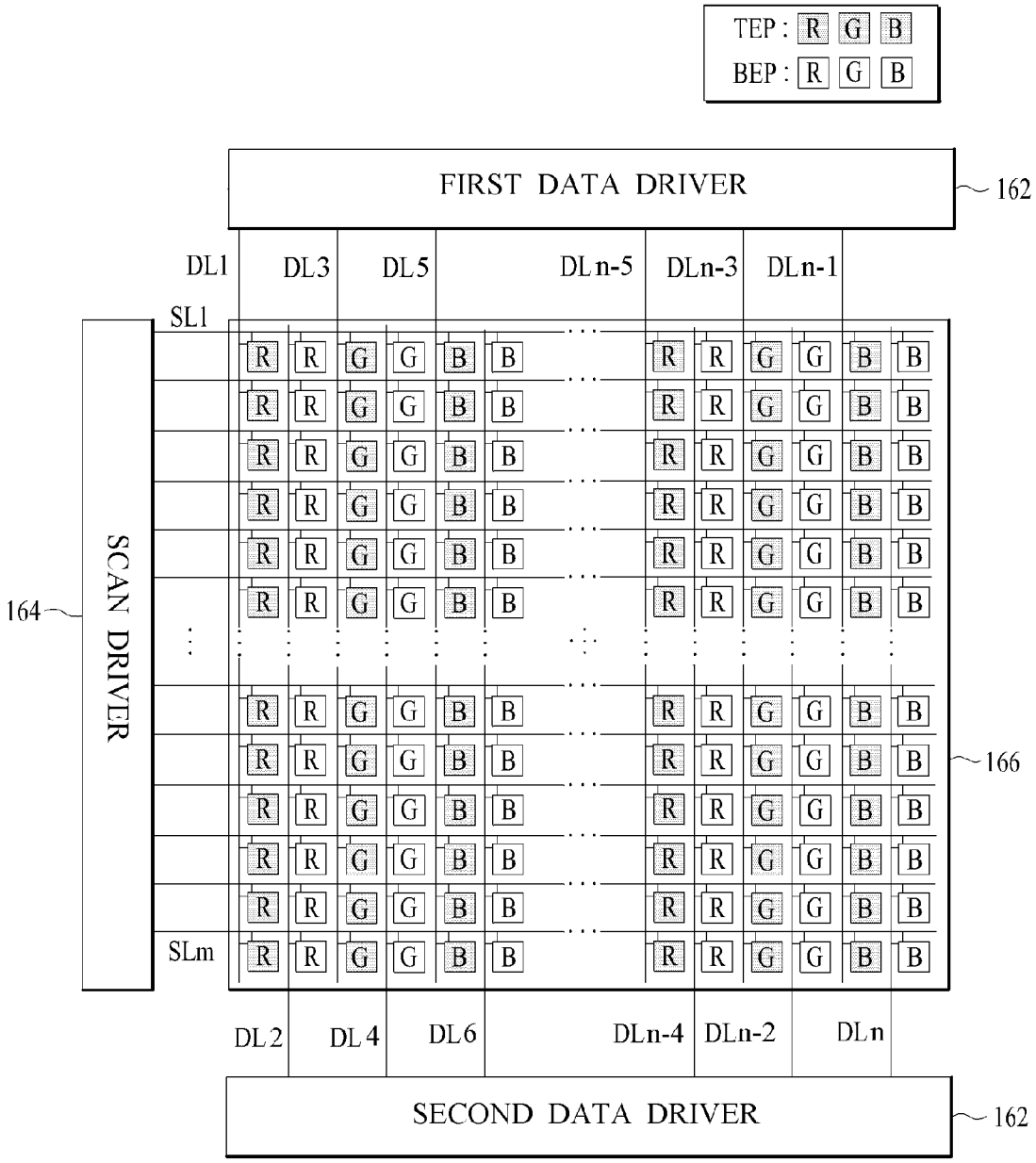
FIG. 13 is a block diagram illustrating arrangement of red, green, and blue emission pixels in the organic electroluminescent display panel shown in FIG. 8.

On the other hand, when top emission pixels TEP and bottom emission pixels BEP are formed to alternate with each other on a data line (DL) basis, as shown in FIG. 13, they may be arranged such that adjacent ones of the top emission pixels TEP and bottom emission pixels BEP in an extension direction of the scan lines SL, namely, a horizontal direction in FIG. 13, render the same color. In this case, accordingly, emission pixels are arranged such that emission pixels rendering the same color are arranged along each data line DL, and emission pixels of at least three colors are repeatedly arranged on a 2i-pixel basis (i: a natural number) along each scan line SL. For example, the top emission pixels TEP connected to the "6j+1"-th data line (j: a natural number including "0") and the bottom emission pixels BEP connected to the "6j+2"-th data line render red R. The top emission pixels TEP connected to the "6j+3"-th data line and the bottom emission pixels BEP connected to the "6j+4"-th data line render green G. The top emission pixels TEP connected to the "6j+5"-th data line and the bottom emission pixels BEP connected to the "6j+6"-th data line render blue B. In this case, a top emission data voltage is supplied to the odd-numbered data lines DL1, DL3, DL5, . . . , DLn-1 from a first data driver 162 disposed over the liquid crystal panel 166. Also, a bottom emission data voltage is supplied to the even-numbered data lines DL2, DL4, DL6, . . . , DLn-1 from a second data driver 162 disposed beneath the liquid crystal panel 166.

Figure 14:
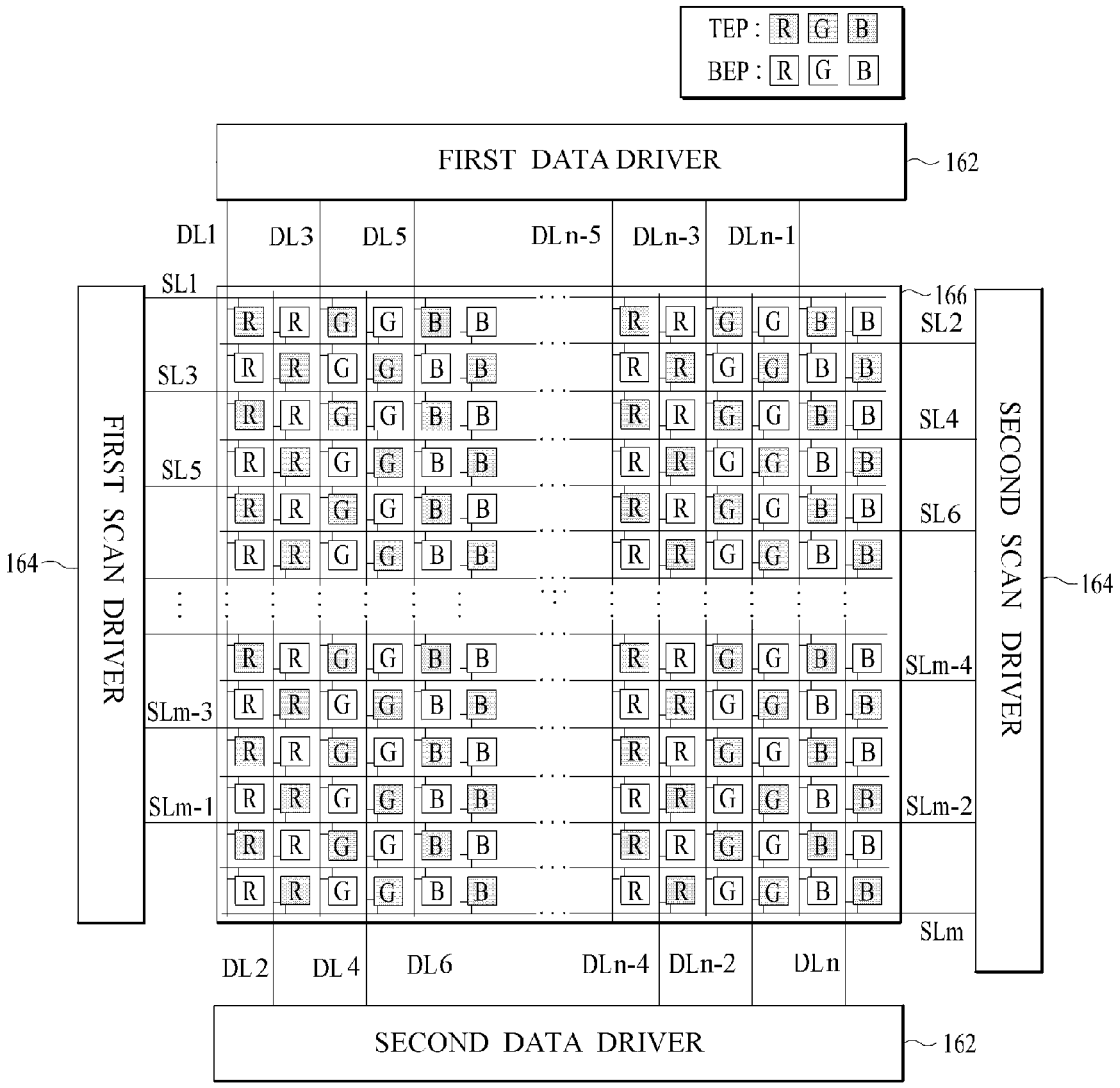
FIG. 14 is a block diagram illustrating arrangement of red, green, and blue emission pixels in the organic electroluminescent display panel shown in FIG. 9.

Also, when top emission pixels TEP and bottom emission pixels BEP are arranged in the form of a mosaic, as shown in FIG. 14, emission pixels rendering the same color are arranged along each data line DL, and emission pixels of at least three colors are repeatedly arranged on a 2i-pixel basis (i: a natural number) along each scan line SL. In this case, the top emission pixels TEP and bottom emission pixels BEP arranged on the same horizontal line are connected to different scan lines SL. Thus, the driving transistors and switching transistors of the top emission pixels TEP and bottom emission pixels BEP arranged on the same horizontal line are arranged in a zigzag manner.

In this case, when a scan signal is supplied to one of the odd-numbered scan lines SL1, SL3, SL5, . . . , SLm-1 from the first scan driver 164 disposed at one side of the liquid crystal panel 166, a top emission data voltage is supplied to the odd-numbered data lines DL1, DL3, DL5, . . . , DLn-1 connected to the top emission pixels TEP connected to the odd-numbered scan line, to which the scan signal is supplied, from the first data driver 162 disposed over the liquid crystal panel 166. In this case, the top emission data voltage is also supplied to the even-numbered data lines DL2, DL4, DL6, . . . , DLn connected to the top emission pixels TEP connected to the even-numbered scan line, to which the scan signal is supplied, from the second data driver 162 disposed beneath the liquid crystal panel 166. Meanwhile, when a scan signal is supplied to one of the even-numbered scan lines SL2, SL4, SL6, . . . , SLm from the second scan driver 166 disposed at the other side of the liquid crystal panel 166, a bottom emission data voltage is supplied to the odd-numbered data lines DL1, DL3, DL5, . . . , DLn-1 connected to the bottom emission pixels BEP connected to the even-numbered scan line, to which the scan signal is supplied, from the first data driver 162 disposed over the liquid crystal panel 166. In this case, the bottom emission data voltage is also supplied to the even-numbered data lines DL2, DL4, DL6, . . . , DLn connected to the bottom emission pixels BEP connected to the even-numbered scan line, to which the scan signal is supplied, from the second data driver 162 disposed beneath the liquid crystal panel 166.

Figure 15:
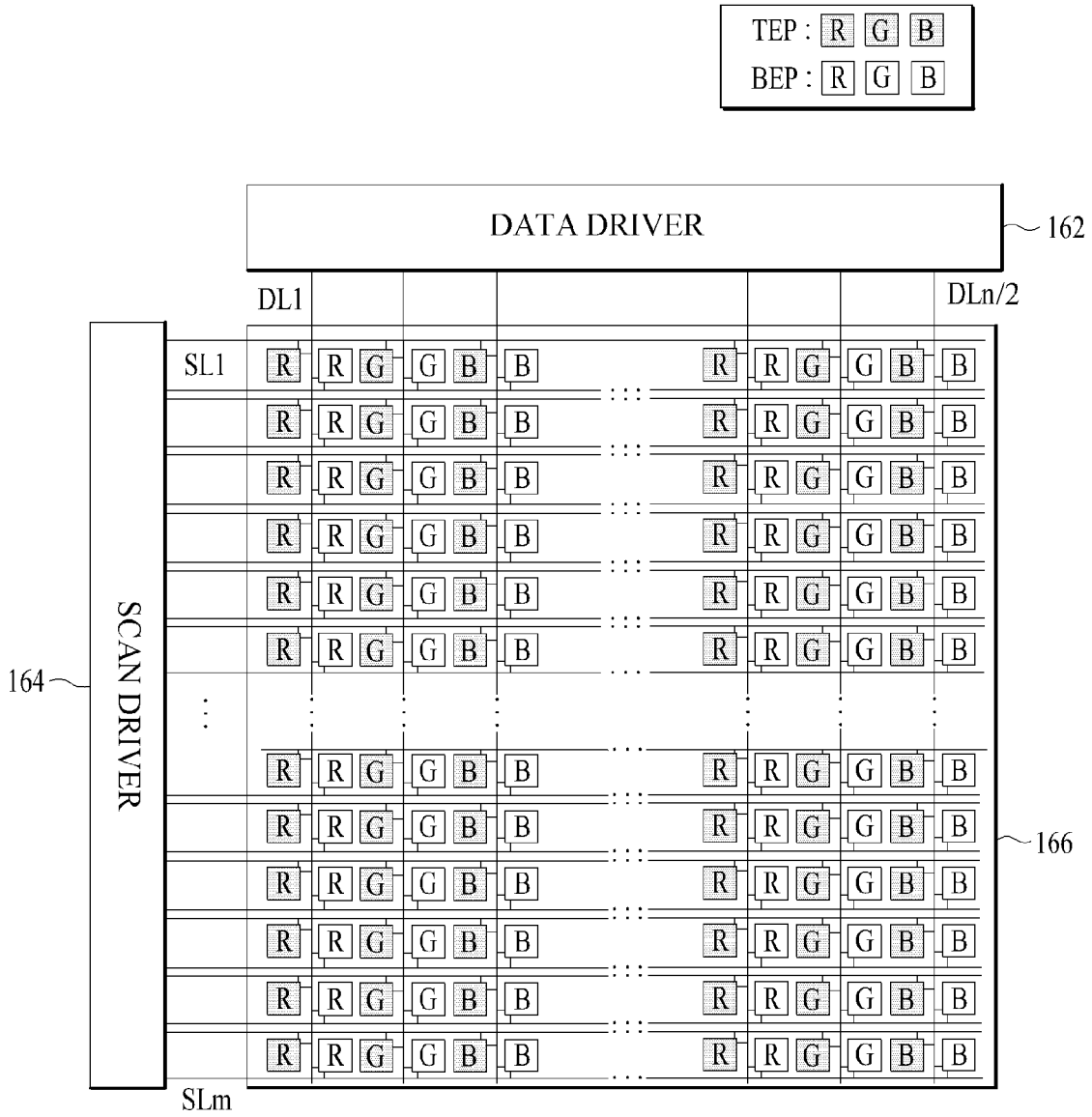
FIG. 15 is a block diagram illustrating an organic electroluminescent display device according to a fourth embodiment of the present invention.

FIG. 15 is a block diagram illustrating an organic electroluminescent display device according to a fourth embodiment of the present invention.

Adjacent ones of top emission pixels TEP and bottom emission pixels BEP in an extension direction of scan lines SL, namely, a horizontal direction, share one data line DL. The top emission pixels TEP and bottom emission pixels BEP connected to the same data line DL are connected to different ones of the scan lines SL, respectively. Thus, the driving transistors and switching transistors of the top emission pixels TEP and bottom emission pixels BEP arranged on the same horizontal line are arranged in a zigzag manner.

In the organic electroluminescent display device shown in FIG. 15, first, a scan signal is supplied to one odd-numbered scan line SL, and a top emission data voltage DATA_T is supplied to the data lines DL. Accordingly, the top emission pixels TEP, which are connected to the data lines DL while being connected to the odd-numbered scan line, emit light of corresponding colors toward the top side. Subsequently, a scan signal is supplied to one even-numbered scan line SL, and a bottom emission data voltage DATA_B is supplied to the data lines DL. Accordingly, the bottom emission pixels BEP, which are connected to the data lines DL while being connected to the even-numbered scan line, emit light of corresponding colors toward the bottom side.

In accordance with repetition of the above-described operations, in one frame, the organic light emitting cells of the top emission pixels TEP connected to the odd-numbered scan lines SL1, SL3, . . . , SLn-1 and the organic light emitting cells of the bottom emission pixels BEP connected to the even-numbered scan lines SL2, SL4, . . . , SLn emit light in an alternating manner. Thus, it is possible to display different images on opposite sides of the display panel of the organic electroluminescent display device, respectively.

Since the top emission pixels TEP and bottom emission pixels BEP, which render the same color, share one data line DL in the above-described embodiment of the present invention, it is possible to reduce the number of data lines by half, and thus to secure an enlarged common transparent area.

Meanwhile, although the present invention has been described in conjunction with the case in which red, green, and blue emission pixels are provided, red, green, blue and white emission pixels may be provided.

As apparent from the above description, in accordance with the present invention, it is possible to display different images on opposite sides of the display panel of the organic electroluminescent display device, using top emission pixels and bottom emission pixels formed on a substrate. Also, since each top emission pixel and each bottom emission pixel share one common transparent area, it is possible to secure desired transparency and to achieve an enhancement in resolution.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An organic electroluminescent display device comprising:

an organic electroluminescent display panel comprising a plurality of top emission pixels having a top emission area and a common transparent area, and a plurality of bottom emission pixels having a bottom emission area and the common transparent area, the common transparent area for transmitting external light there through is positioned between each top emission area and each bottom emission area;

a scan driver for supplying a scan signal to scan lines each connected to selected ones of the top and bottom emission pixels; and a data driver for supplying a data voltage to data lines each connected to selected ones of the top and bottom emission pixels, wherein the top emission pixels and the bottom emission pixels are formed on the substrate to alternate with each other on a pixel basis, on a scan line basis, or a data line basis.

2. The organic electroluminescent display device according to claim 1, wherein:

each of the top and bottom emission pixels comprises a switching transistor connected to a corresponding one of the scan lines and a corresponding one of the data lines, a driving transistor comprising a gate connected to a drain of the switching transistor, and a source connected to a voltage line, to which a high-level voltage is supplied, and an organic light emitting cell comprising a first electrode connected to a drain of the driving transistor, a second electrode, to which a low-level voltage is supplied, and an organic light emitting layer formed between the first electrode and the second electrode, wherein each of the bottom emission pixels further comprises a top reflection plate disposed under the organic light emitting layer, and wherein each of the top emission pixels further comprises a bottom reflection plate disposed over the organic light emitting layer.

3. The organic electroluminescent display device according to claim 2, wherein:

the top emission pixels and the bottom emission pixels are formed to alternate with each other on a scan line basis;

the switching transistor of each of the top emission pixels is connected to one selected from odd-numbered the scan lines and even-numbered scan lines; and the switching transistor of each of the bottom emission pixels is connected to the other of the odd and even-numbered scan lines.

4. The organic electroluminescent display device according to claim 3, wherein the scan driver comprises:

a first scan driver for supplying a scan signal to the scan line connected to the switching transistor of the top emission pixel; and a second scan driver for supplying a scan signal to the scan line connected to the switching transistor of the bottom emission pixel.

5. The organic electroluminescent display device according to claim 2, wherein:

the top emission pixels and the bottom emission pixels are formed to alternate with each other on a data line basis;

the switching transistor of each of the top emission pixels is connected to one selected from odd-numbered data lines and even-numbered data lines; and the switching transistor of each of the bottom emission pixels is connected to the other of the odd and even data lines.

6. The organic electroluminescent display device according to claim 5, wherein the data driver comprises:

a first data driver for supplying a data signal to the data line connected to the switching transistor of the top emission pixel; and a second data driver for supplying a data signal to the data line connected to the switching transistor of the bottom emission pixel.

7. The organic electroluminescent display device according to claim 2, wherein the top emission pixels and the bottom emission pixels are formed to alternate with each other on a pixel basis such that the top and bottom emission pixels are arranged in the form of a mosaic.

8. A method for driving an organic electroluminescent display device, comprising:

supplying a scan signal to scan lines each connected to selected ones of top emission pixels, each top emission pixel having a top emission area and a common transparent area, to emit light toward a top side of a substrate and bottom emission pixels, each bottom emission pixel having a bottom emission area and the common transparent area, to emit light toward a bottom side of the substrate;

supplying a data voltage to data lines each connected to selected ones of the top and bottom emission pixels; and rendering images on opposite sides of an organic electroluminescent display panel in which the top emission pixels and the bottom emission pixels are formed on the substrate to alternate with each other, wherein corresponding ones of the top emission pixels and the bottom emission pixels share the common transparent area for transmitting external light there through, and the top emission pixels and the bottom emission pixels are formed on the substrate to alternate with each other on a pixel basis, on a scan line basis, or a data line basis.

9. The method according to claim 8, wherein the rendering images on opposite sides of an organic electroluminescent display panel comprises:

emitting light toward a top side of the organic electroluminescent display panel from the top emission pixels each including a switching transistor formed between a corresponding one of the scan lines and a corresponding one of the data lines, a driving transistor having a gate connected to a drain of the switching transistor and a source connected to a voltage line, to which a high-level voltage is supplied, and an organic light emitting cell having a first electrode connected to a drain of the driving transistor, a second electrode, to which a low-level voltage is supplied, an organic light emitting layer formed between the first electrode and the second electrode, and a top reflection plate disposed beneath the organic light emitting layer; and emitting light toward a bottom side of the organic electroluminescent display panel from the bottom emission pixels each including a switching transistor formed between a corresponding one of the scan lines and a corresponding one of the data lines, a driving transistor having a gate connected to a drain of the switching transistor of the bottom emission pixel and a source connected to the voltage line, and an organic light emitting cell having a first electrode connected to a drain of the driving transistor of the bottom emission pixel, a second electrode, to which the low-level voltage is supplied, an organic light emitting layer formed between the first electrode and the second electrode in the bottom emission pixel, and a bottom reflection plate disposed beneath the organic light emitting layer in the bottom emission pixel.

10. The driving method according to claim 9, wherein:

the supplying a scan signal to the scan lines comprises supplying the scan signal from a first scan driver to the switching transistors of selected ones of the top emission pixels, the selected top emission pixels being connected to one selected from odd-numbered scan lines and even-numbered scan lines, and supplying the scan signal from a second scan driver to the switching transistors of selected ones of the bottom emission pixels, the selected bottom emission pixels being connected to the other of the odd and even-numbered scan lines; and the rendering images on opposite sides of the organic electroluminescent display panel comprises emitting light from the organic light emitting cells of the top emission pixels and the organic light emitting cells of the bottom emission pixels in an alternating manner at intervals of one horizontal period.

11. The method according to claim 9, wherein:

the supplying a data voltage to the data lines each connected to selected ones of the top and bottom emission pixels comprises supplying a top emission data voltage from a first data driver to the switching transistors of selected ones of the top emission pixels, the selected top emission pixels being connected to one selected from odd-numbered data lines and even-numbered data lines, while supplying a bottom emission data voltage from a second data driver to the switching transistors of selected ones of the bottom emission pixels, the selected bottom emission pixels being connected to the other of the odd and even data lines, when the scan signal is supplied to the scan line to which the selected top emission pixels and the selected bottom emission pixels are connected; and the rendering images on opposite sides of the organic electroluminescent display panel comprises emitting light from the organic light emitting cells of the top emission pixels and the organic light emitting cells of the bottom emission pixels in a simultaneous manner at intervals of one horizontal period.

12. The method according to claim 9, wherein:

the supplying a data voltage to the data lines each connected to selected ones of the top and bottom emission pixels comprises supplying a top emission data voltage from a first data driver to the switching transistors of selected ones of the top emission pixels, the selected top emission pixels being connected to odd-numbered data lines and to an odd-numbered scan lines, while supplying a top emission data voltage from a second data driver to the switching transistors of selected ones of the bottom emission pixels, the selected bottom emission pixels being connected to an even-numbered data lines and to the odd-numbered scan line, when the scan signal is supplied from a first scan driver to the odd-numbered scan line, and supplying a bottom emission data voltage from the first data driver to the switching transistors of selected ones of the bottom emission pixels, the selected bottom emission pixels being connected to the odd-numbered data line and to even-numbered scan lines, while supplying a bottom emission data voltage from the second data driver to the switching transistors of selected ones of the top emission pixels, the selected top emission pixels being connected to the even-numbered data line and to the even-numbed scan line, when the scan signal is supplied to the even-numbered scan line; and the organic light emitting cells of the top emission pixels and the organic light emitting cells of the bottom emission pixels emit light in an alternating manner at intervals of one horizontal period.

13. An organic electroluminescent display device comprising:

an organic electroluminescent display panel comprising a plurality of top emission pixels having a top emission area and a common transparent area, and a plurality of bottom emission pixels having a bottom emission area and the common transparent area, the common transparent area for transmitting external light there through is positioned between each top emission area and each bottom emission area;

a scan driver for supplying a scan signal to scan lines each connected to selected ones of the top and bottom emission pixels; and a data driver for supplying a data voltage to data lines each connected to selected ones of the top and bottom emission pixels, wherein the top emission pixels and the bottom emission pixels are formed on the substrate to alternate with each other on a pixel basis, on a scan line basis, or a data line basis, and wherein the top and bottom emission pixels formed on the substrate to alternate with each other on a pixel basis, on a scan line basis or a data line basis share a corresponding one of the data lines.

14. The organic electroluminescent display device according to claim 13, wherein selected ones of the top emission pixels connected to odd-numbered scan lines and selected ones of the bottom emission pixels connected to even-numbered scan lines are connected to a corresponding one of the data lines.

15. The organic electroluminescent display device according to claim 1, wherein a switching transistor and a driving transistor of each of the top emission pixels, and a switching transistor and a driving transistor of each of the bottom emission pixels are symmetrically formed at opposite sides of the corresponding common transparent area.

16. The method according to claim 8, wherein a switching transistor and a driving transistor of each of the top emission pixels, and a switching transistor and a driving transistor of each of the bottom emission pixels are symmetrically formed at opposite sides of the corresponding common transparent area.

17. The organic electroluminescent display device according to claim 13, wherein each of the top emission pixels and bottom emission pixels includes a switching transistor and a driving transistor, and wherein the switching transistor and the driving transistor of each of the top emission pixels, and the switching transistor and driving transistor of each of the bottom emission pixels are symmetrically formed at opposite sides of the corresponding common transparent area.

* * * * *